US005899602A

United States Patent [19]

Noda et al.

[11] Patent Number: 5,899,602

[45] Date of Patent: May 4, 1999

[54] PROCESS CARTRIDGE, PROCESS CARTRIDGE ASSEMBLY METHOD, AND IMAGE FORMING APPARATUS

[76] Inventors: Shinya Noda; Yoshikazu Sasago; Haruhisa Oshida; Toshiyuki Karakama, all of Canon Kabushiki Kaisha 3-30-2 Shimomaruko, Ohta-ku, Tokyo, Japan

[21] Appl. No.: 08/637,386

[22] Filed: Apr. 25, 1996

[30] Foreign Application Priority Data

Apr. 28, 1995 [JP] Japan ..... 7-104995

[51] Int. Cl.[6] ..... G03G 15/04

[52] U.S. Cl. ..... 399/111; 399/119; 399/258

[58] Field of Search ..... 399/25, 27, 110, 399/111, 113, 114, 119, 258, 262

[56] References Cited

U.S. PATENT DOCUMENTS

| | | | |
|---|---|---|---|
| 5,028,966 | 7/1991 | Kozuka et al. | 399/113 |
| 5,294,960 | 3/1994 | Nomura et al. | 399/113 |
| 5,331,372 | 7/1994 | Tsuda et al. . | |
| 5,475,470 | 12/1995 | Sasago et al. . | |
| 5,485,249 | 1/1996 | Higeta et al. | 399/110 X |
| 5,500,714 | 3/1996 | Yashiro et al. . | |
| 5,502,547 | 3/1996 | Shirai | 399/111 X |
| 5,537,187 | 7/1996 | Sekine | 399/113 |
| 5,543,898 | 8/1996 | Shishido et al. . | |
| 5,585,895 | 12/1996 | Yashiro et al. . | |

FOREIGN PATENT DOCUMENTS

| | | |
|---|---|---|
| 0632342A3 | 1/1995 | European Pat. Off. . |
| 0634707A2 | 1/1995 | European Pat. Off. . |
| 708387A2 | 4/1996 | European Pat. Off. . |

*Primary Examiner*—Sandra L. Brase

[57] ABSTRACT

A toner accommodating container usable with a process cartridge detachably mountable to a main assembly of an image forming apparatus, wherein the process cartridge includes an electrophotographic photosensitive member and a process means actable on the electrophotographic photosensitive member includes a toner accommodating portion for accommodating toner usable for developing a latent image formed on the electrophotographic photosensitive member; a partition wall extending in the toner accommodating portion in a direction along a short side of the toner accommodating portion to define a plurality of space therein; a toner filling opening, at a longitudinal end of the toner accommodating portion, for permitting toner to be filled into the toner accommodating portion; and a through-passage extending from one longitudinal end to the other longitudinal end along a length of the toner accommodating portion so as to permit the toner to be supplied into the spaces.

43 Claims, 21 Drawing Sheets

PROCESS CARTRIDGE, PROCESS CARTRIDGE ASSEMBLY METHOD, AND IMAGE FORMING APPARATUS

FIELD OF THE INVENTION AND RELATED ART

The present invention relates to a process cartridge, a method for assembling a process cartridge, and an image forming apparatus.

The image forming apparatus in this specification includes an electro-photographic copying machine, an electro-photographic printer (for example, an LED printer or a laser beam printer), an electro-photographic facsimile, an electro-photographic word processor, and the like.

The process cartridge in this specification is a cartridge which is removably installable in the main assembly of an image forming apparatus, and in which a charging means, a developing means or a cleaning means, and an electro-photographic photosensitive member are integrally housed. It may integrally comprise an electro-photographic photosensitive member, and at least the charging means, the developing means, or the cleaning means, or may integrally comprise an electro-photographic photosensitive member, and at least the developing means. The charging means, the developing means, and the cleaning means are processing means which act on the electro-photographic photosensitive member.

A process cartridge system in which the aforementioned process cartridge is removably installed in the main assembly of an image forming apparatus, has been employed in an image forming apparatus based on the electro-photographic image formation process. According to this process cartridge system, users themselves can maintain the image forming apparatus; there is no need for service personnel. Therefore, this process cartridge system can remarkably improve the operational efficiency of the image forming apparatus. Consequently, the process cartridge system has been widely employed in the field of the image forming apparatus.

The present invention is a result of the further development of the aforementioned process cartridge.

SUMMARY OF THE INVENTION

Accordingly, a primary object of the present invention is to provide a process cartridge which can be assembled with improved efficiency, a method for assembling the process cartridge with improved efficiency, and an image forming apparatus compatible with such a process cartridge.

Another object of the present invention is to provide a process cartridge in which an electro-photographic photosensitive member and a developing means can be reliably disposed, a method for assembling such a process cartridge, and an image forming apparatus compatible with such a process cartridge.

Another object of the present invention is to provide a process cartridge capable of reliably keeping the electro-photographic photosensitive member and the developing means in contact with each other with a predetermined contact pressure, a method for assembling such a process cartridge, and an image forming apparatus compatible with such a process cartridge.

According to an aspect of the present invention, there is provided a toner accommodating container usable with a process cartridge detachably mountable to a main assembly of an image forming apparatus, wherein the process cartridge includes an electrophotographic photosensitive member and a process means actable on the electrophotographic photosensitive member, comprising: a toner accommodating portion for accommodating toner usable for developing a latent image formed on the electrophotographic photosensitive member; a partition wall extending in the toner accommodating portion in a direction along a short side of the toner accommodating portion to define a plurality of space therein; a toner filling opening, at a longitudinal end of the toner accommodating portion, for permitting toner to be filled into the toner accommodating portion; and a through-passage extending from one longitudinal end to the other longitudinal end along a length of the toner accommodating portion so as to permit the toner to be supplied into the spaces.

According to another aspect of the present invention, there is provided a process cartridge detachably mountable to a main assembly of an image forming apparatus, comprising: a. an electro-photographic photosensitive member; b. process means actable on the electrophotographic photosensitive member; c. a toner accommodating container, including: a toner accommodating portion for accommodating toner usable for developing a latent image formed on the electrophotographic photosensitive member; a partition wall extending in the toner accommodating portion in a direction along a short side of the toner accommodating portion to define a plurality of space therein; a toner filling opening, at a longitudinal end of the toner accommodating portion, for permitting toner to be filled into the toner accommodating portion; and a through-passage extending from one longitudinal end to the other longitudinal end along a length of the toner accommodating portion so as to permit the toner to be supplied into the spaces.

According to a further aspect of the present invention, there is provided an electrophotographic image forming apparatus for forming an image on a recording material, wherein a process cartridge is detachably mountable to the image forming apparatus, comprising: a. mounting means for detachably mounting a process cartridge; the process cartridge including: aa. an electrophotographic photosensitive member; bb. process means actable on the electrophotographic photosensitive member; cc. a toner accommodating container, including: a toner accommodating portion for accommodating toner usable for developing a latent image formed on the electrophotographic photosensitive member; a partition wall extending in the toner accommodating portion in a direction along a short side of the toner accommodating portion to define a plurality of space therein; a toner filling opening, at a longitudinal end of the toner accommodating portion, for permitting toner to be filled into the toner accommodating portion; and a through-passage extending from one longitudinal end to the other longitudinal end along a length of the toner accommodating portion so as to permit the toner to be supplied into the spaces; the apparatus further comprising: b. feeding means for feeding the recording material.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferable embodiments of the present invention will be described in detail with reference to the drawings.

First, referring to FIGS. 1–14, a process cartridge in accordance with the present invention, and an electro-photographic image forming apparatus usable with such a process cartridge will be described in detail. As for the order in which descriptions are given, the general structures of the process cartridge and the image forming apparatus employing the process cartridge will be described at first, and then, cartridge installing means, the structure for opening or closing a drum shutter, the opening or closing movement of the drum shutter, and the structure of cartridge frames will follow. Thereafter, a method for joining the aforementioned two cartridge frames will be described.

{General Structure}

Figure 4:
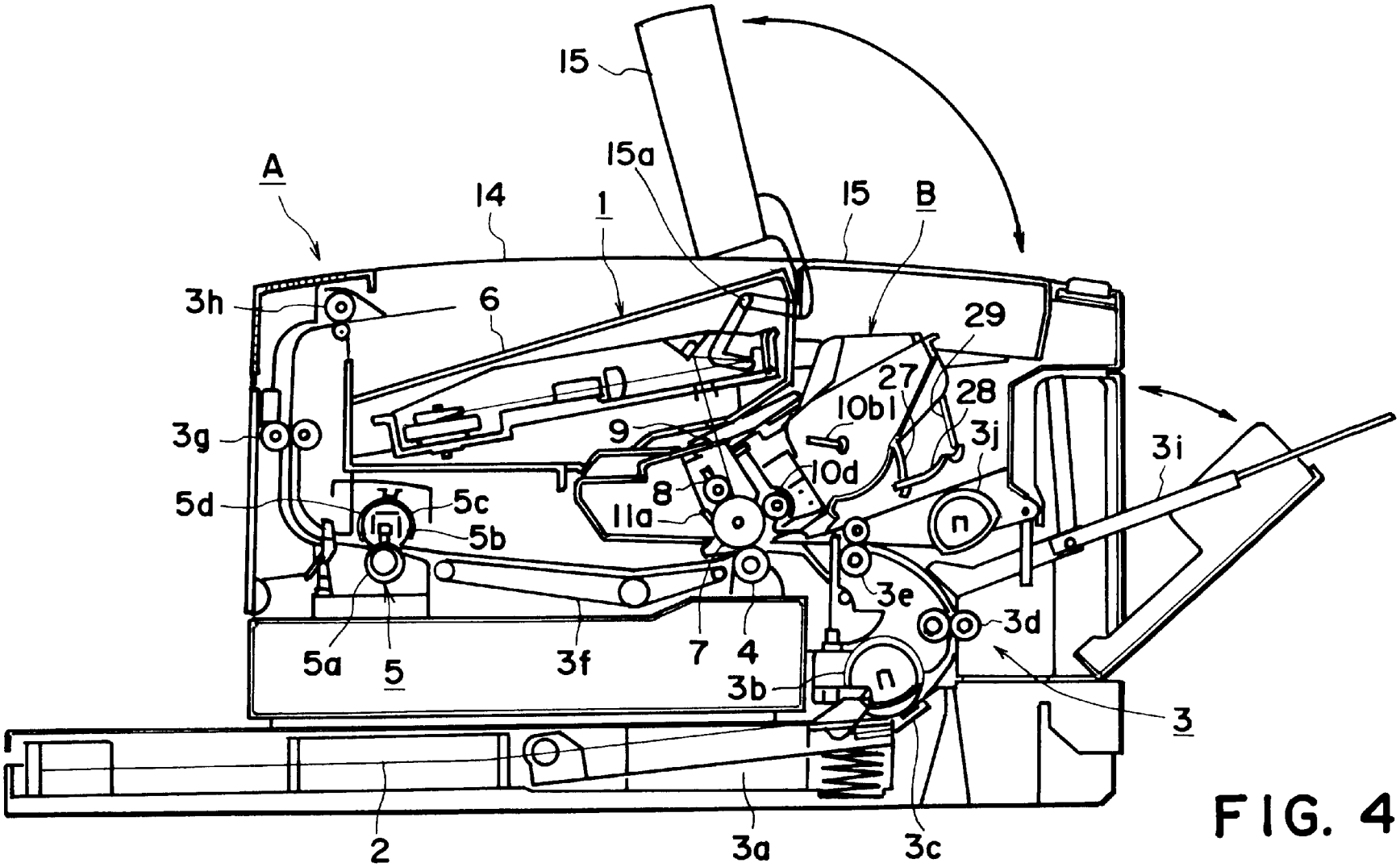
FIG. 4 is a schematic section of an electro-photographic image forming apparatus, depicting the general structure thereof.

Referring to FIG. 4, in the electro-photographic image forming apparatus A (laser beam printer) in accordance with the present invention, a light beam which carries image data is projected from an optical system 1 onto an electro-photographic photosensitive member in the form of a drum to form a latent image thereon, and this latent image is developed into a toner image. The electro-photographic photosensitive member is charged by a charge roller 8 before it is irradiated with the image data carrying light beam. In synchronism with the formation of the toner image, recording media 2 disposed in a sheet feeder cassette 3*a* are separated and fed into the electro-photographic image forming apparatus one by one by a pickup roller 3*b* and a pressing member 3*c* placed in contact with the pickup roller 3*b* to apply a predetermined pressure. The recording medium 2 is further conveyed into the apparatus by a conveying means 3 comprising a conveyer roller pair 3*d,* a registration roller pair 3*e,* and the like. As a voltage is applied to a transfer roller 4 as a transferring means, the toner image formed on the electro-photographic photosensitive member integrally disposed in a process cartridge B is transferred onto the recording medium 2. The recording medium 2 having received the toner image is delivered to a fixing means 5 by a conveyer belt 3*f.* The fixing means 5 comprises a driving roller 5*a,* and a fixing roller 5*d.* The fixing roller 5*d* contains a heater 5*b* and is rotatively supported by a supporting member 5*c.* While the recording medium 2 is passed through the fixing means 5, heat and pressure are applied to the recording medium 2, whereby the toner image having been transferred onto the recording medium is fixed to the recording medium 2. The recording medium 2 with the fixed toner image is conveyed through a reversing passage and discharged into a sheet catcher portion 6, by discharge roller pairs 3*g* and 3*h.* This image forming apparatus A also comprises a manual feeder tray 3*i* and a roller pair 3*i* so that the recording medium 2 can be manually fed.

Figure 5:
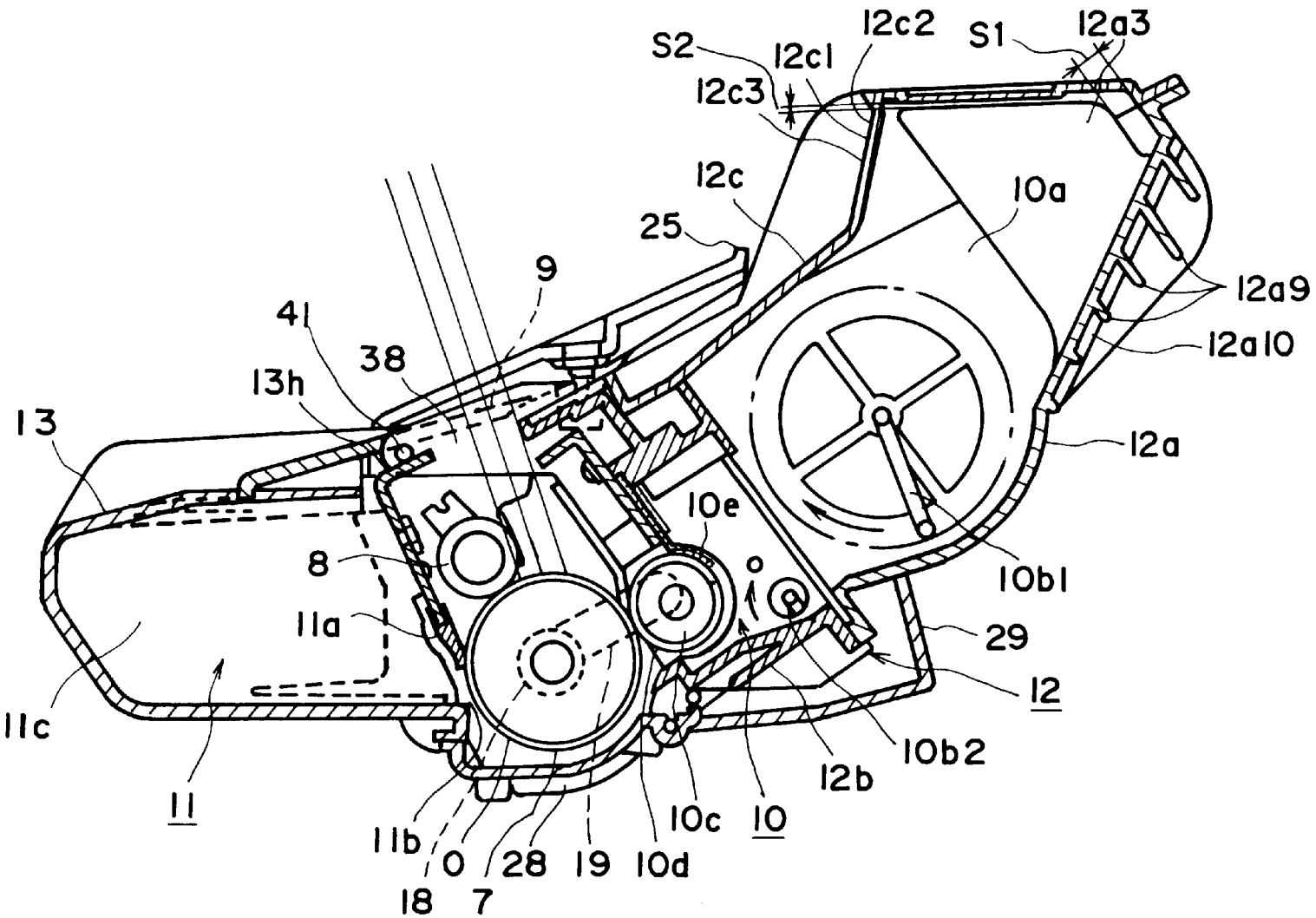
FIG. 5 is a cross-section of a process cartridge.

The process cartridge B in accordance with the present invention comprises an electro-photographic photosensitive member and a minimum of one processing means. The processing means includes a charging means for charging the electro-photographic photosensitive member, a developing means for developing the latent image formed on the electro-photographic photosensitive member, a cleaning means for cleaning the toner remaining the surface of the electro-photographic photosensitive member, and the like. Referring to FIG. 5, in the process cartridge B, a photosensitive drum 7, which is a drum-shaped electro-photographic photosensitive member with a photosensitive layer, is rotated, and the surface of the rotating photosensitive drum 7 is uniformly charged by applying a voltage to the charge roller 8 which is the charging means. The surface of the photosensitive drum 7 is exposed to an optical image projected from the aforementioned optical system 1 through an opening 9, whereby a latent image is formed on the photosensitive drum 7. The latent image is developed by a developing means 10. As is evident from FIG. 5, the charge roller 8 is in contact with the photosensitive drum 7.

In the developing means 10, the toner contained in a toner holding portion 10*a* is sent out by a first rotary toner feeding member 10*b*1 and a second rotary toner feeding member 10*b*2, onto a development roller 10*d,* which is a developing member containing a fixed magnet 10*c.* As the development roller 10*d* is rotated, a layer of toner triboelectrically charged by the development blade 10*e* is formed on the surface of the development roller 10*d*. The toner particles in the toner layer are transferred onto the photosensitive drum 7 in correspondence to the aforementioned latent image, whereby the latent image is developed into a toner image, that is, a visible image.

After the toner image is transferred onto the recording medium 2 by applying to the transfer roller 4 a voltage with a polarity opposite to that of the toner image, the toner remaining on the photosensitive drum 7 is removed by a cleaning means 11 comprising a cleaning blade 11*a* for scraping off the residual toner, a reception sheet 11*b* for receiving the toner scraped from the photosensitive drum 7, and a waste toner collector 11*c* for collecting the waste toner. As is evident from FIG. 5, the cleaning blade 11*a* is in contact with the photosensitive drum 7.

The components such as the photosensitive drum 7 are integrally disposed within the frame of the process cartridge B, so that they can be removably installed within the apparatus main assembly 14. The cartridge frame is formed by joining a development frame 12 and a cleaning frame 13. The development frame 12 is formed by welding together a development frame 12*a*, a development frame bottom portion 12*b*, and a development frame lid 12*c*.

{Cartridge Installating Means}

Figure 7:
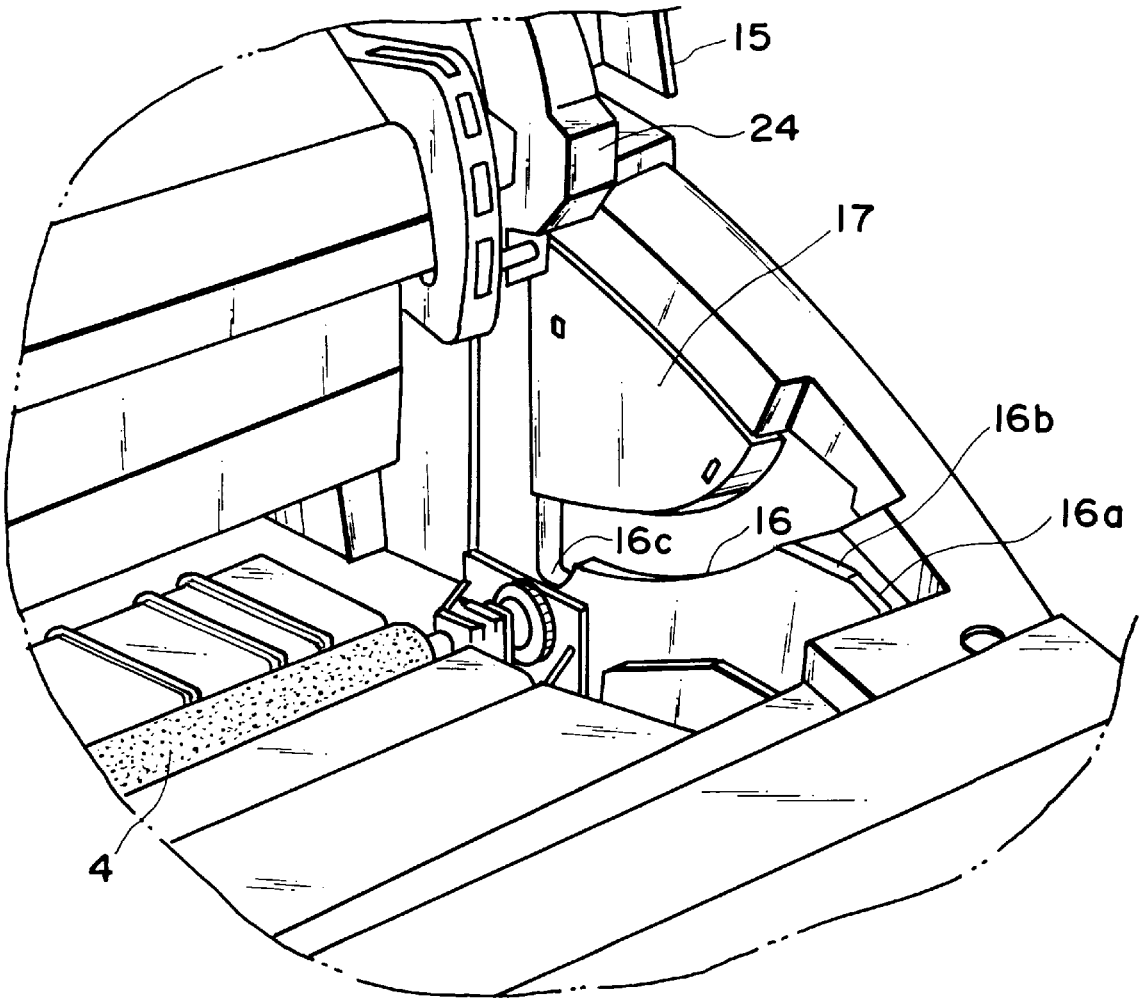
FIG. 7 is an explanatory drawing depicting the structure of the right-hand guide for guiding the process cartridge during the insertion or removal thereof.
Figure 8:
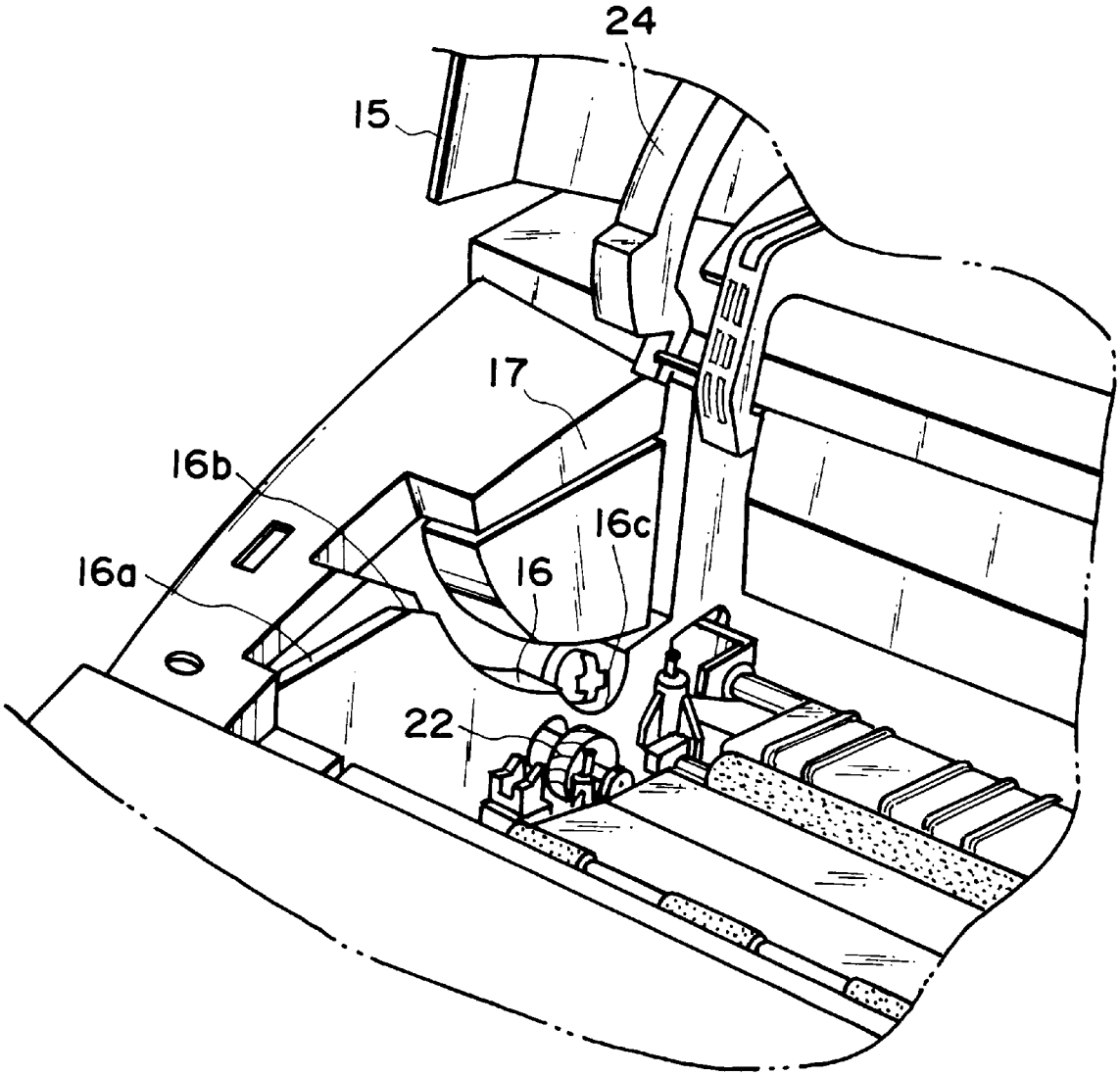
FIG. 8 is an explanatory drawing depicting the structure of the left-hand guide for guiding the process cartridge during the insertion or removal thereof.

The process cartridge B is installed in the apparatus main assembly 14 by opening the lid 15 as shown in the drawing. Referring to FIGS. 7 and 8, the cartridge installating means comprises a pair of guide rails 16, which are exposed as the lid 15 is rotatively opened about an axis 15*a* (FIG. 4). The guide rails 16 are given an upward bowing curvature (in this embodiment, substantially arc-shaped), and symmetrically located in the respective lateral walls of the apparatus main assembly 4 across the cartridge accommodating space. Above the guide rail 16, a guide member 17 is attached. On the entrance side of the guide rail 16, a first slant surface 16*a*, and a second slant surface 16*b* are provided. The second slant surface 16*b* has a steeper angle than the first slant surface 16*a*, and extends further downward from the bottom end of the first slanted surface 16*a*.

Figure 6:
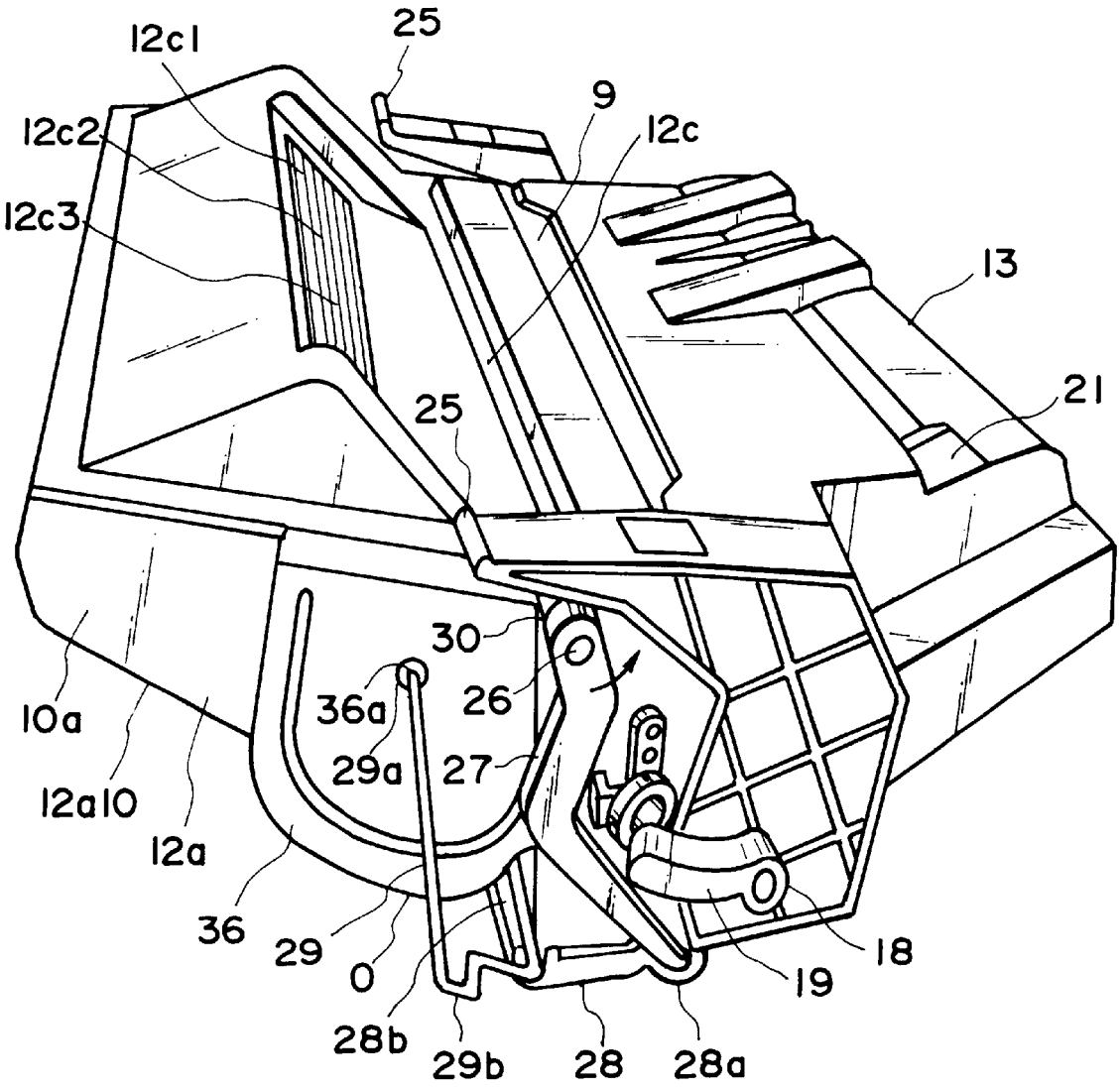
FIG. 6 is an external perspective view of the process cartridge.

On the other hand, the surfaces of the left and right longitudinal ends of the process cartridge B are provided with a guide portion, wherein the two guide portions symmetrically project in the longitudinal direction from the correspondent end surfaces of the process cartridge B, and are guided by the guide rail 16. Referring to FIG. 6, the guide portion integrally comprises a boss portion 18 and a rib portion 16. The boss portion 18 and the rib portion 16 are integrally formed with the cleaning frame 13 to which the photosensitive drum 7 is attached. The boss portion 18 is in line with the imaginary extension of the rotational axis of the photosensitive drum 7, and the rib portion 19 extends backward, relative to the inserting direction of the process cartridge B, from the boss portion 18, forming a upward bowing curvature (in this embodiment, substantially arc-shaped), which matches the configuration of the guide rail 16.

Referring to FIGS. 10–15, when the process cartridge B is installed into the apparatus main assembly with the above described structure, the lid 15 is first opened, and the process cartridge B is inserted into the apparatus main assembly so that the leading end of the process cartridge B is caused to dive into the space below the optical means 1. The guide rail 16 is arc-shaped, and the guide member 17 disposed above the guide rail 16 is given a configuration matching that of the guide member 17. Further, the rib 19 also is given a configuration similar to that of the guide member 17. Consequently, as the process cartridge B is inserted deeper, its orientation becomes substantially horizontal. As the cartridge B is pushed further inward, a bumping member 20 provided on the apparatus main assembly 14 comes in contact with a contact surface 21 provided on each longitudinal end of the leading end portion of the cleaning frame 13, and then, the boss portion 18 of the process cartridge drops into a recess 16*c* located at the deepest end of the guide rail 16. As a result, a drum gear (unillustrated) fixed to one of the longitudinal ends of the photosensitive drum 7 is caused to engage with the driving gear 22 (FIG. 8) provided on the apparatus main assembly 14 side, enabling the driving force to be transmitted to the process cartridge B.

Figure 12:
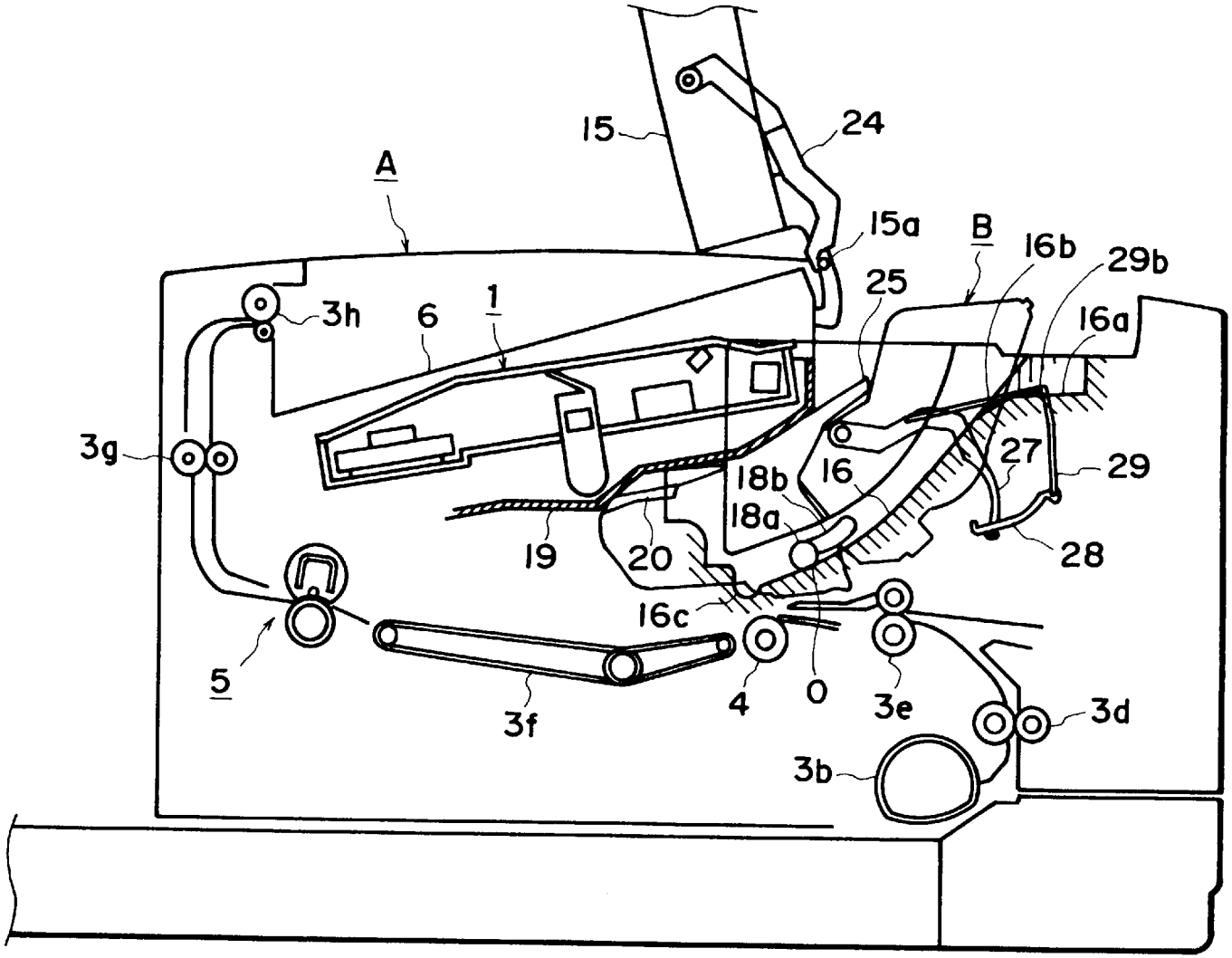
FIG. 12 is a sectional view depicting the state of the process cartridge having been further inserted into the image forming apparatus.

Next, referring to FIG. 12, as the lid 15 is closed, a pressing member 24, which is axially supported on the lid 15, and is under the pressure from a torsional coil spring, makes contact with the arm portion 15 of the cleaning frame 13, pressing it with a predetermined pressure generated from the torsional coil spring being torqued by the closing movement of the lid 15. At the same time, the bumping member 20 provided on the apparatus main assembly 14 makes contact with the contact surface 21 of the process cartridge B, fixing the position of the process cartridge B.

Figure 15:
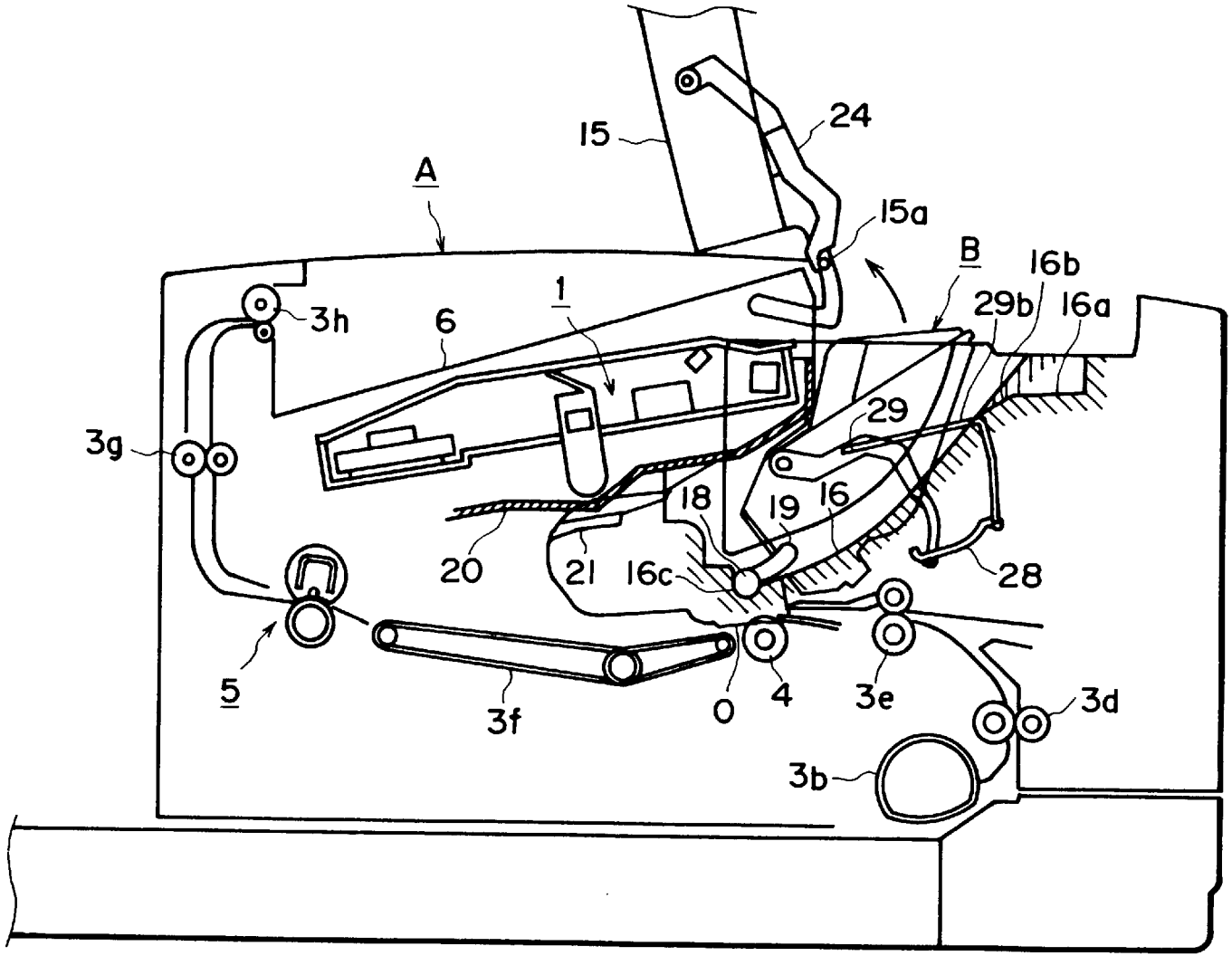
FIG. 15 is a sectional drawing depicting the image forming apparatus, the lid of which is open, and in which the process cartridge has been completely installed.

Referring to FIG. 15, in order to take out the process cartridge B, the users open the lid 15, whereby the pressure applied through the pressing member 24 is removed. In this state, the cartridge B is pulled upward so that the boss portion 18 comes out of the recess 16*c*. Thereafter, the process cartridge B can be removed by pulling it as if rotating it in the the counterclockwise direction of FIG. 12, with the rib portion 19 following the guide rail 16.

Figure 11:
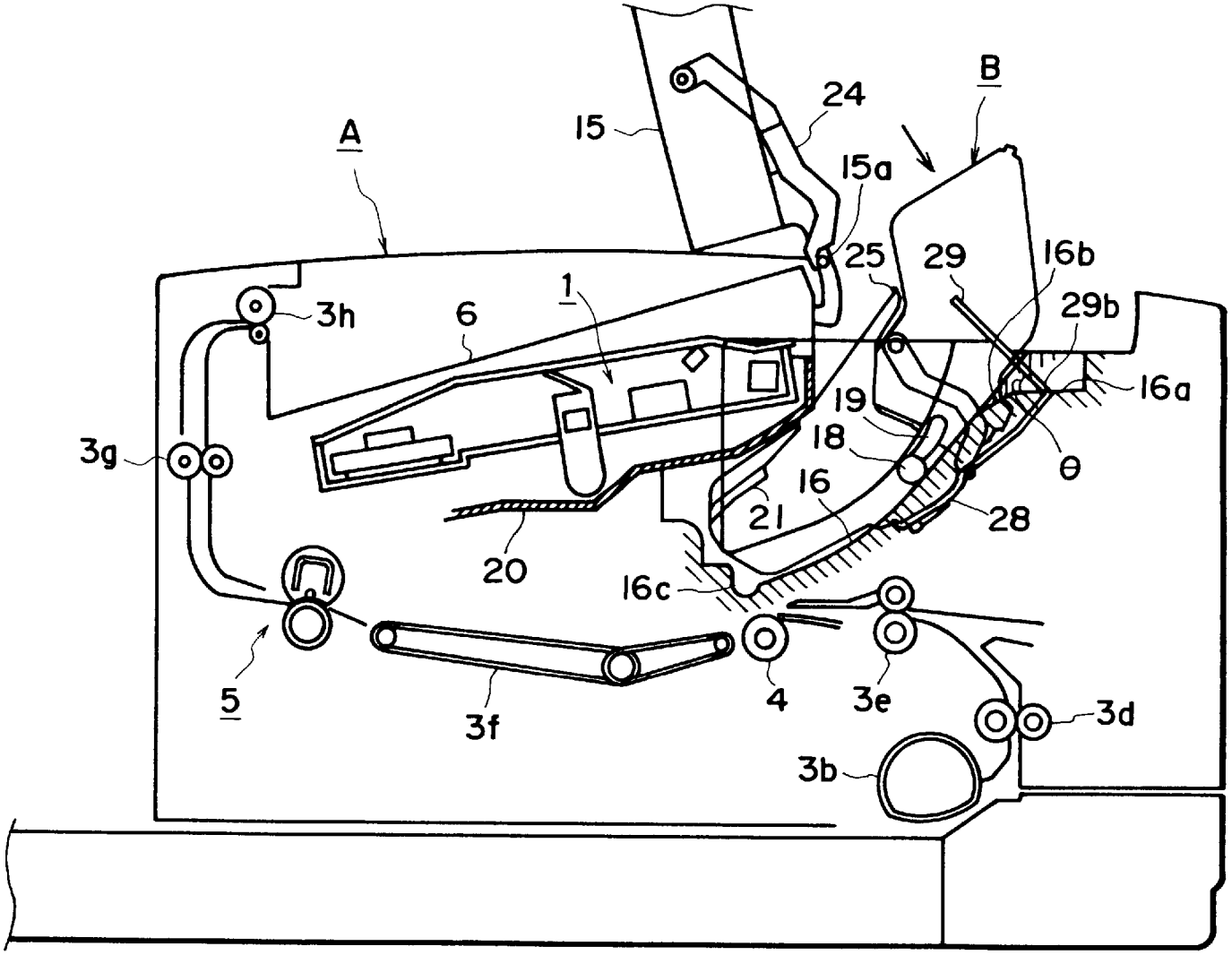
FIG. 11 is a sectional drawing depicting the state of the process cartridge having been further inserted into the image forming apparatus.

The bottom portion of the cartridge frame is provided with an opening O, through which the photosensitive drum 7 comes in contact with the conveyed recording medium 2. When the cartridge is not in use, the opening is covered by closing a drum shutter member 28 to protect the photosensitive drum 7. Referring to FIG. 6, the drum shutter member 28 is rotatively supported by a shutter arm 27 and a link member 29. The shutter arm 27 is rotatively mounted on an axis 26 projecting outward from the longitudinal lateral wall of the development frame 12, but the link member 29 is supported on the longitudinal lateral wall of the cartridge frame so that it can be rotated about the rotational center 29*a*. As the process cartridge B is inserted along the guide rail 16 as described above, a projecting portion 29*b* constituted of the bend portion of the link member 29 comes in contact with the first and second slant surfaces 16*a* and 16*b* of the guide rail 16, causing the shutter member 28 to open (FIGS. 11 and 12). On the contrary, as the process cartridge B is taken out, the shutter member 28 is automatically closed by the pressure from the torsional coil spring 30 (FIG. 6) fitted around the axis 26.

When the process cartridge B is inserted into or removed from the image forming apparatus A, the users pick up process cartridge B by the handhold portion 12*c*2 of the development frame 12. The handhold portion 12*c*2 comprises the slanted upward facing surface of the cartridge lid 12*c*. Referring to FIG. 6, this slanted portion, that is, the handhold portion 12*c*2, is provided with minute ridges and valleys formed by numerous ribs 12*c*1 (extending in the direction perpendicular to the direction in which the process cartridge B is inserted into, or removed from, the apparatus main assembly). Referring to FIG. 5, the bottom portion of the cartridge frame is provided with an R portion which bulges downward, and this R portion is provided with several ribs 12*a*9 extending in the same direction as the aforementioned ribs 12*a*1, constituting the handhold portion

Figure 20:
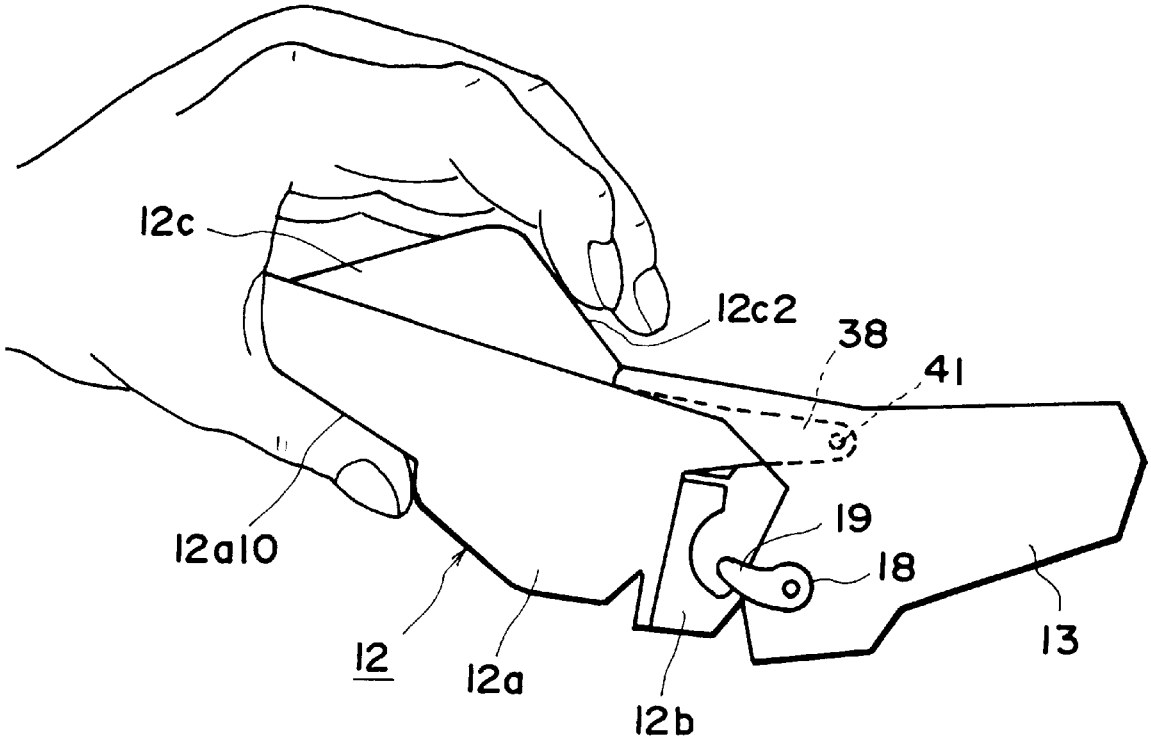
FIG. 20 is a perspective drawing depicting how the process cartridge is held by a hand.

12*a*10. In order to install the process cartridge B into the image forming apparatus A, or remove it therefrom, the users pick up the process cartridge B by grasping it by the handhold portions 12*c*2 and 12*a*10 (ribs 12*c*1 and ribs 12*a*9) as illustrated in FIG. 20, and then insert it into the apparatus main assembly, with the boss portion 18 and the rib portion 19 of the cleaning frame 13 following the guide rail 16.

When the process cartridge B is pushed into the apparatus main assembly excessively fast, the process cartridge B is liable to be subjected to a large shock, which mostly acts on the pin 41 joining the development frame 12 and the cleaning frame 13. However, the development frame 12 and the cleaning frame 13 are rotatable about the pin 41; therefore, the aforementioned shock is distributed throughout the entire cartridge frame; the shock does not concentrated on a specific portion. In other words, the shock does not concentrate on the welded joint between the toner holding frame portion 12*a* and the development frame bottom portion 12*b*. Therefore, the strength with which the toner holding frame portion 12*a* and the development frame bottom portion 12*b* are welded has only to be enough to keep the both frame portions 12*a* and 12*b* joined. Consequently, when welding the toner holding frame portion 12*a* and the development frame bottom portion 12*b*, it is unnecessary to specifically control the welding conditions, allowing the development frame 12 to be assembled without losing productivity.

Further, the means for positioning the development roller 10*d*, and a mounting seat for the development blade 10*e*, are provided on the toner holding frame portion 12*a* as described in the foregoing. Therefore, in spite of the fact that the toner holding frame portion 12*a* is provided with the arm portion 38, the development roller 10*d* and the development blade 10*e* can be precisely positioned, so that their positional relationship with the photosensitive drum 7 mounted on the cleaning frame 13 can be maintained with sufficient precision.

{Structure for Opening or Closing Drum Shutter}

Figure 18:
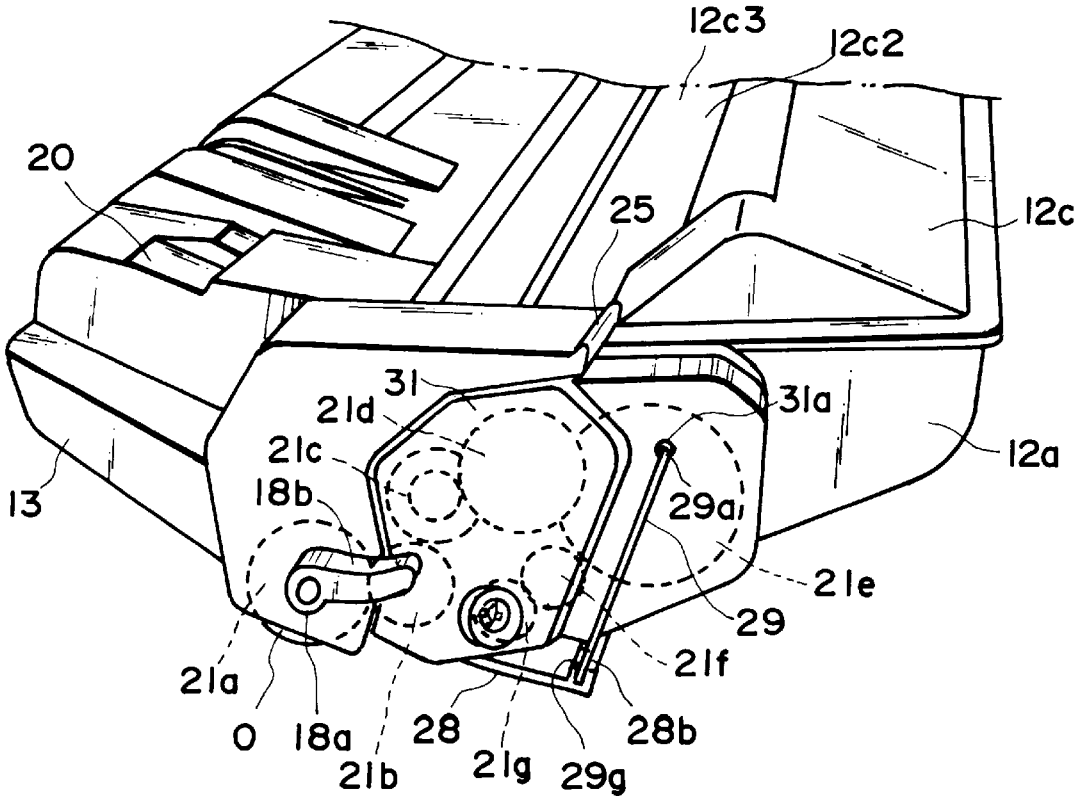
FIG. 18 is an external perspective view of the process cartridge.
Figure 19:
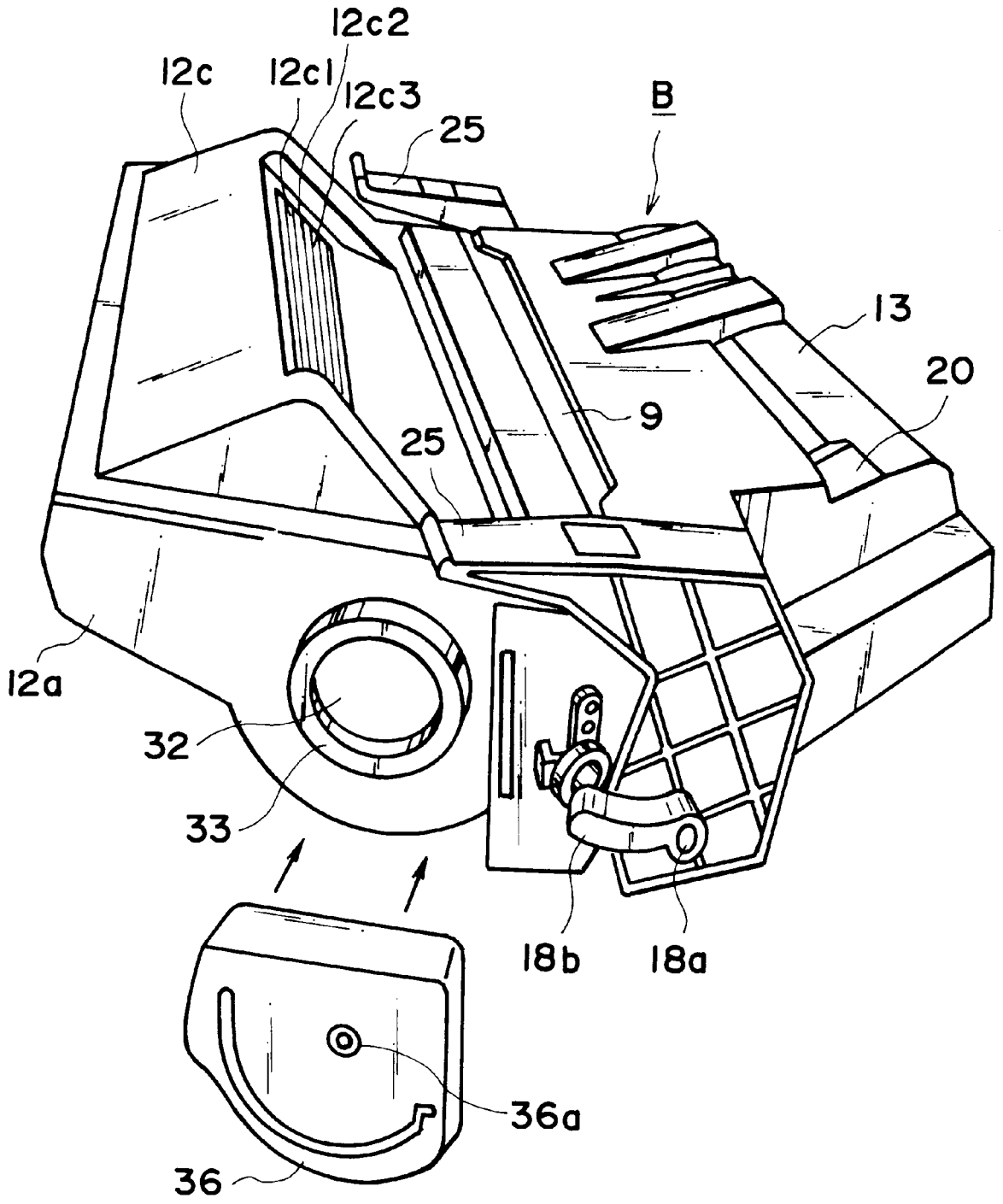
FIG. 19 is a perspective view of the process cartridge, depicting how a linking member is attached thereto.

Referring to FIGS. 6, 18 and 19, the structure for opening or closing the aforementioned drum shutter will be described.

(Structure for Opening or Closing)

Referring to FIG. 6, one end of the shutter arm 27 is rotatively mounted on the axis 26 provided on the longitudinal end surface of the toner holding frame portion 12*a*, and to the other end, a ring portion 28*a* formed at one end of the shorter edge of the drum shutter member (protective cover) 28 is rotatively attached. The shutter member 28 is provided with a groove 28*b*, which runs adjacent to the longitudinal edge on the side opposite to the ring portion 28*a*, across the entire length of the edge. In this groove 28*b*, the shutter link member (supporting member) 29 formed by bending the metallic wire is rotatively anchored.

Referring to FIGS. 6 and 18, the end portion 29*a* of the link member 29 is rotatively supported by a link supporting member 36 and a gear cover 31. Referring to FIG. 19, the link supporting member 36 covers a toner filling opening 32 of the toner holding frame portion 12*a*. During the assembly process of the process cartridge B, toner is filled into the toner holding portion 10*a* through the toner filling opening 32, and the toner filling opening 32 is sealing with a cap 33. Thereafter, the link supporting member 36 is welded to the toner holding frame portion 12*a*, covering cap 33.

The link supporting member (link mount) 36 is provided with an axis hole 36*a*, which is located at a specific spot (after the welding of the link supporting member 36 to the toner holding frame portion 12*a*, it is located directly above the toner filling opening 32). The end portion 29*a* of the link member 29 is inserted into this axis hole 36*a*, whereby the link member 29 is rotatively supported at the end portion 29*a*.

Referring to FIG. 18, on the other side of the process cartridge B, a gear train comprising a drum gear 21*a* fixed to the longitudinal end of the photosensitive drum 7, and gears 21*b*–21*g*, are mounted on the longitudinal end surface of the toner holding frame portion 12*a*. This gear train transmits a driving force to the development roller 10*d* and the toner sending members 10*b*1 and 10*b*2. The aforementioned gear cover 31 is attached to cover this gear train. The other end 29*a* of the link member 29 is inserted into an axis hole 31*a* provided in the gear cover 31 to rotatively support the link member 29 at the other end 29*a*.

When seen from the direction indicated by an arrow mark in FIG. 6, the link member 29 forms an L-shape, and from its bend portion, a U-shaped projection 29*b* projects outward in the longitudinal direction of the process cartridge B. As this projection 29*b* is rotatively moved, the link member 29 is rotatively moved, whereby the shutter member 28 is caused to expose or cover the opening O.

The aforementioned axis 26 is provided with a torsional coil spring 30, one end of the spring 30 being anchored to the shutter arm 27 and the other end being anchored to the cleaning frame 13; therefore, the shutter member 28 remains under the constant pressure in the closing direction generated by the elasticity of the spring 30.

(Opening and Closing Movement)

Next, referring to FIGS. 10–15, the opening and closing movements of the drum shutter 28 will be described. First, referring to FIG. 11, as the process cartridge B is inserted into the image forming apparatus A as described before, the projection 29*b* of the link member 29 comes in contact with the first slanted surface 16*a* of the guide rail 16. At this moment of the contact, the angle θ formed by the first slanted surface 16*a* and the link member 29 is an acute angle. As a result, the link member 29 and the first slanted surface 16*a* do not prop against each other, allowing the shutter member 28 to be smoothly opened, and also allowing the smooth insertion of the process cartridge B.

Figure 13:
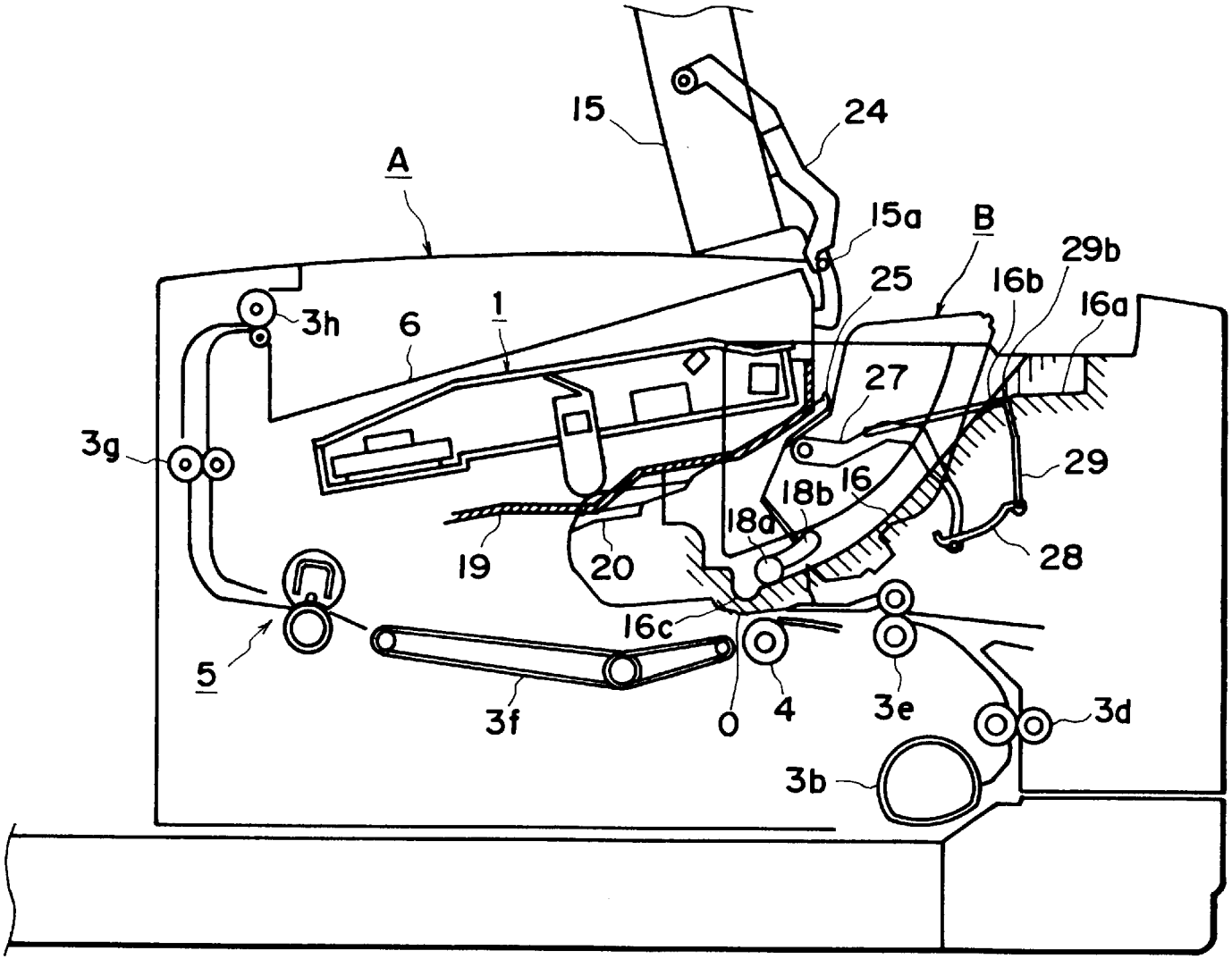
FIG. 13 is a sectional view depicting the state of the process cartridge having been further inserted into the image forming apparatus.
Figure 14:
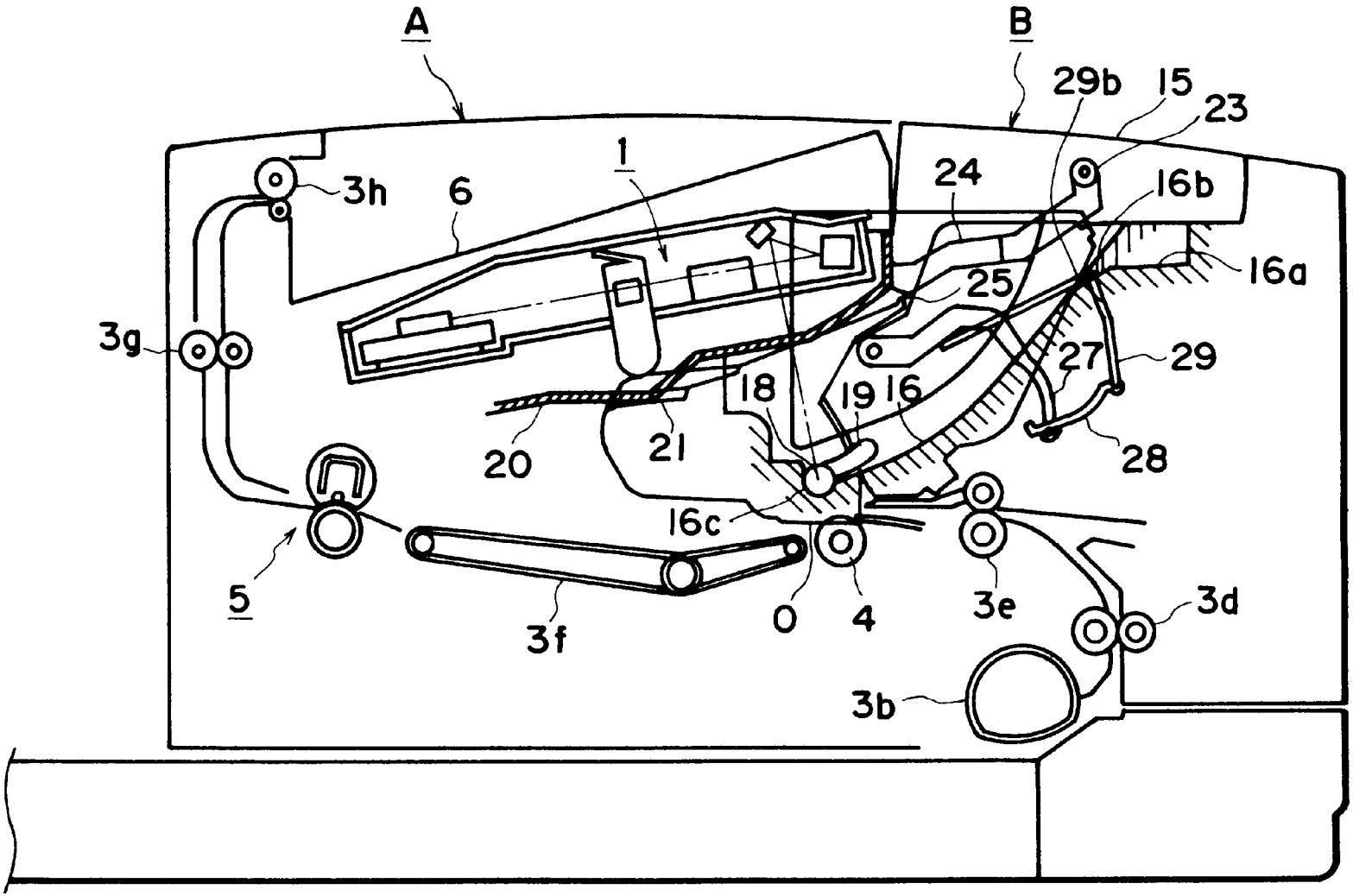
FIG. 14 is a sectional view depicting the state of the process cartridge having been completely installed into the image forming apparatus.

Next, referring to FIG. 12, as the process cartridge B is further inserted, the shutter member 28 is gradually opened backward because the projection 29*b* remains in contact with the first slanted surface 16*a*. As the process cartridge B is inserted deeper, the projection 29*b* moves onto the second slanted surface 16*a* of the guide rail 16, ending the process cartridge B insertion process, as shown in FIGS. 13 and 14. This second slanted surface 16*b* is given a steeper angle than the first slanted surface 16*a*, allowing the shutter member 28 to remain open in the same open state even after the projection 29*b* of the link member 29 moves onto the second slanted surface 16*b* due to the further insertion of the process cartridge B; therefore, the shutter member 28 does not open too far, nor does it fail to open sufficiently.

As described above, the shutter member 28 opens or closes as the link member 29 is rotatively moved. But, because the link member 29 is supported by the link supporting member 36 which covers the toner filling opening 32, the rotational center of the link member 29 can be positioned right above the toner filling opening. Therefore, more latitude can be afforded for the positioning of the rotational center of the link member 29, which otherwise is more restricted since the shutter member 28 must follow a predetermined locus within the limited internal space of the image forming apparatus A; even when the size of the toner filling opening 32 must be designed to be large to increase the toner filling efficiency, more latitude can be afforded in determining the location of the mounting point for the link member 29.

{Structure of Cartridge Frame}

Figure 16:
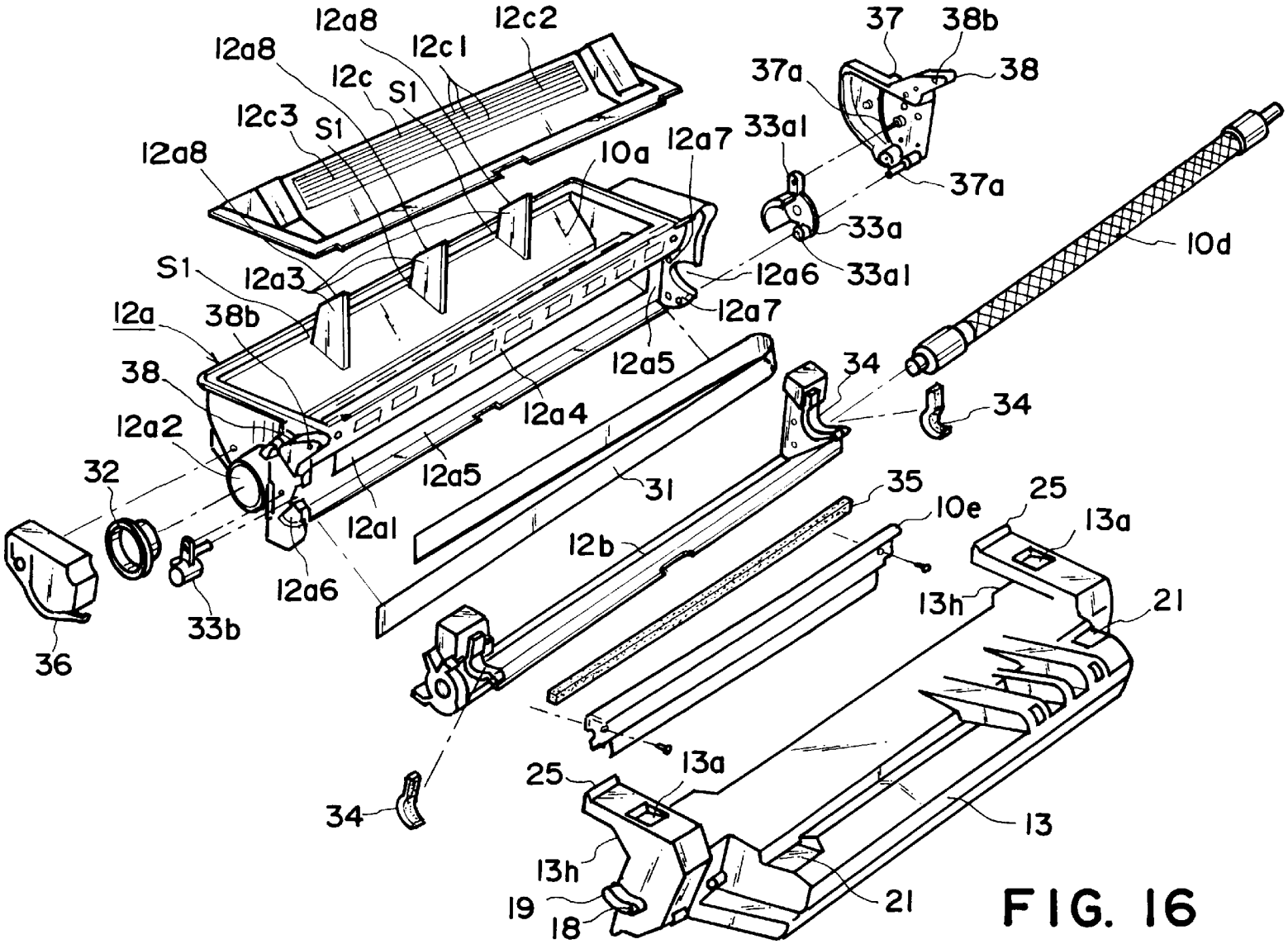
FIG. 16 is an exploded perspective view of the cartridge frame.

Next, the structure of the cartridge frame will be described. The cartridge frame is formed of polystyrol resin using injection molding. Referring to FIG. 16, the cartridge frame is formed by joining a first frame, which is the development frame 12, and a second frame, which is the cleaning frame 13 (drum frame). The development frame 12 is formed by welding the development frame bottom portion 12*b* (development roller supporting frame) to the toner holding frame portion 12*a* along their longitudinal edges, and then, welding the lid 12*c* to the top portion of the preceding two frame portions.

The toner holding frame portion 12*a* is provided with the toner supply opening 12*a*1 and the toner filling opening 12*a*2. The toner supply opening 12*a* extends in the longitudinal direction, and the toner filling opening 12*a*2 is located in one of the longitudinal end walls. Within the toner holding frame portion 12*a,* a number of supporting member 12*a*3 are provided. They stand upright, and are aligned in the longitudinal direction of the frame portion.

Figure 17:
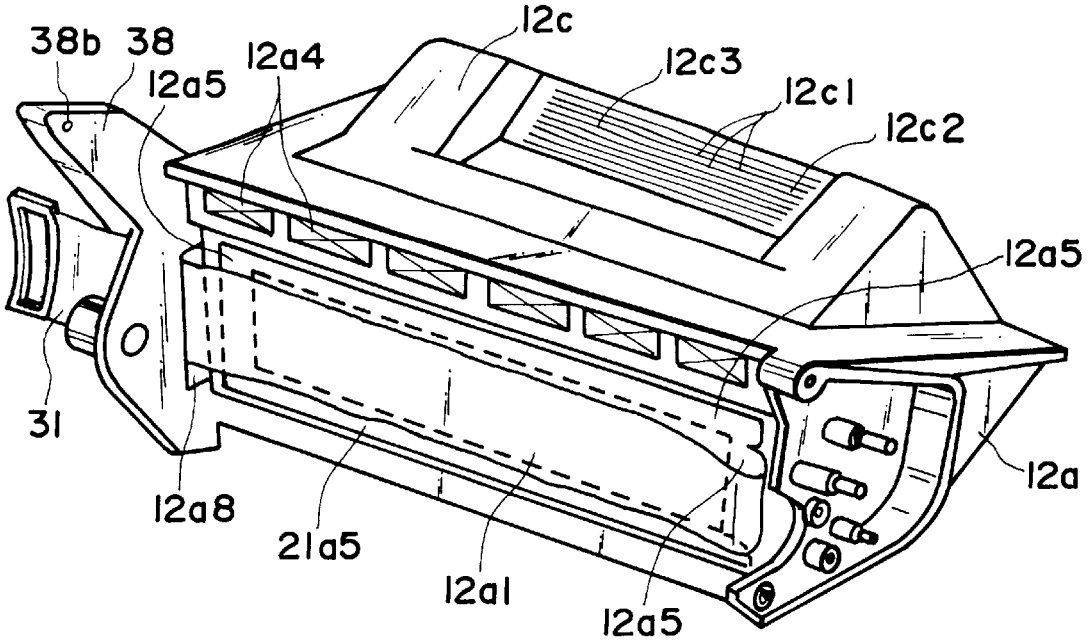
FIG. 17 is a perspective view depicting how the toner seal is attached to the development frame.

When the developing means is assembled, the first toner sending member 10*b*1 is first assembled into the toner holding frame portion 12*a,* and then, the lid member 12 is welded. Next, the toner supply opening 12*a*1 is sealed by welding a toner seal member (film) 31 to the seal attachment seat 12*a*5 formed around the toner supply opening 12*a*1. Then, after toner is filled into the toner holding portion 10*a* of the toner holding frame portion 12*a,* the cap 32 is placed over the toner filling opening 12*a*2 to seal the toner holding portion 10*a*. Referring to FIG. 17, the toner sealing member 31 having sealed the toner supply opening 12*a*1 is folded back at one of the longitudinal ends of the toner supply opening 12*a*1, and its free end is caused to be exposed through a slit 12*a*8 of the toner holding frame portion 12*a,* so that the users can remove the toner sealing member 31 by pulling the exposed free end when the process cartridge B is initially put to use.

Next, the development frame bottom portion 12*b* is welded to the toner holding frame portion 12*a* along the longitudinal edges, and the second toner sending member 10*b*2 is attached to the development frame bottom portion 12*b*. Then, a seal 35 formed of foamed urethane, or the like is attached below a blade mounting seat 12*a*4, and the development blade 10*e* is screwed to the blade mounting seat 12*a*4. Next, bearings 33*a* and 33*b,* a seal 34 formed of foamed urethane or the like, are attached, and the axis of the development roller 10*d* is placed in the bearings 33*a* and 33*b*. The toner holding frame portion 12*a* is provided with an arc-shaped portion 12*a*6, which is a positioning means for fixing the bearings 33*a* and 33*b;* the bearings 33*a* and 33*b* are fixed to the arc-shaped portion 12*a*6 of the toner holding frame portion 12*a*. Therefore, the development roller 10*d,* the axis of which is supported by the bearings 33*a* and 33*b,* is attached to the toner holding frame portion 12*a* with a preferable degree of precision.

The link support member 36 is attached at one of the longitudinal ends of the development frame 12, covering the aforementioned cap 32. On the other side of the development frame 12, the gear train for transmitting the driving force to the photosensitive drum 7, the development roller 10*d,* and the like are mounted, and the gear cover 37 is attached to cover the gear train. The gear cover 37 is provided with a positioning axis 37*a;* the gear cover 37 is fixed to the toner holding frame portion 12*a* using engagement claws, screws, or the like after its position is fixed by inserting this positioning axis 37*a* into the hole 33*a*1 of the bearing 33*a,* and the hole 12*a*7 of the toner holding frame portion 12*a*.

One of the longitudinal ends of the toner holding frame portion 12*a* is provided with an arm portion 38 as a joint portion, which is integrally formed with the toner holding frame portion 12*a*. Also, the gear cover 37 attached to the other longitudinal end of the toner holding frame portion 12*a* is provided with the arm portion 38 as the joint portion (FIG. 16).

The development frame 12, into which various components constituting the aforementioned developing means have been assembled, and the cleaning frame 13, into which the photosensitive drum 7, the charge roller 8, and various components constituting the cleaning means, have been assembled, are joined together at the arm portions 38, completing the process cartridge B.

{Structure for Joining Development Frame and Cleaning Frame}

Figure 1:
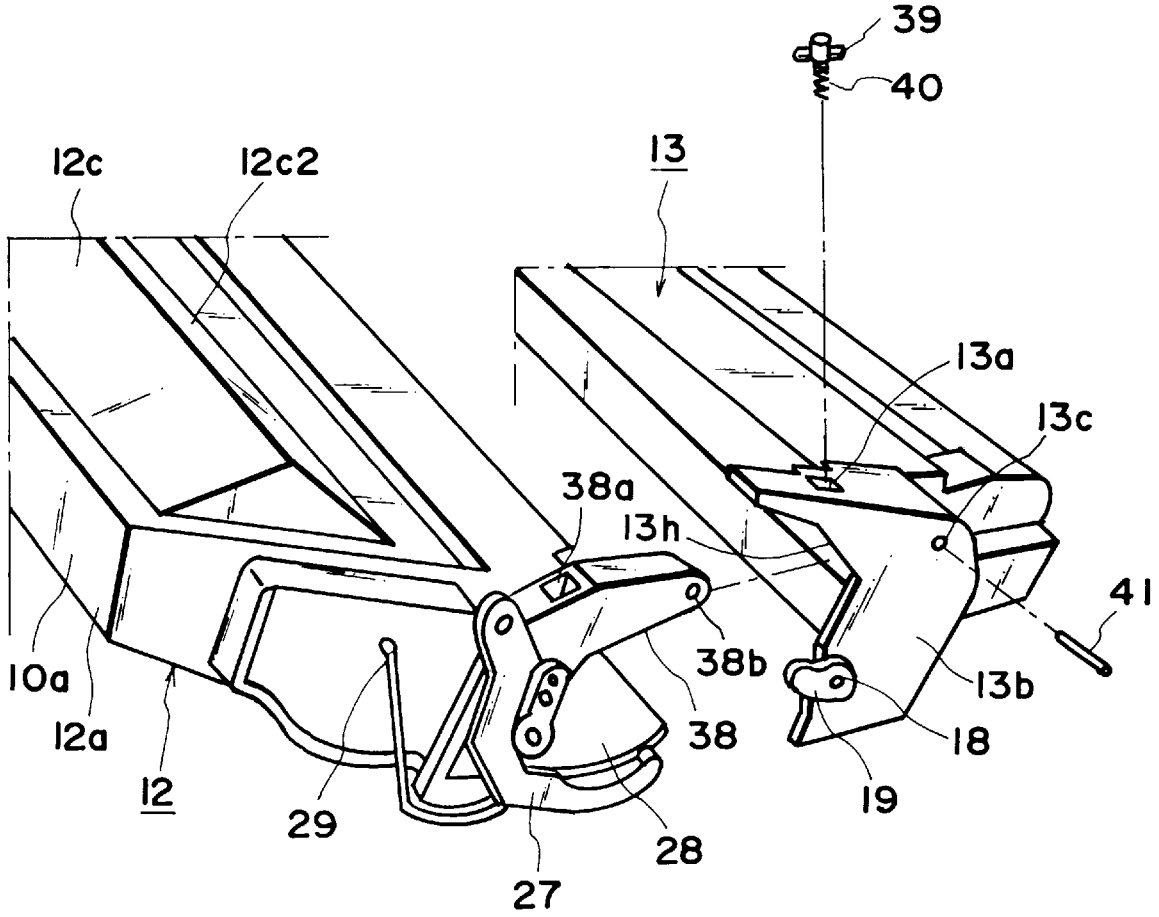
FIG. 1 is a perspective view depicting how a development frame and a cleaning frame are joined.
Figure 2:
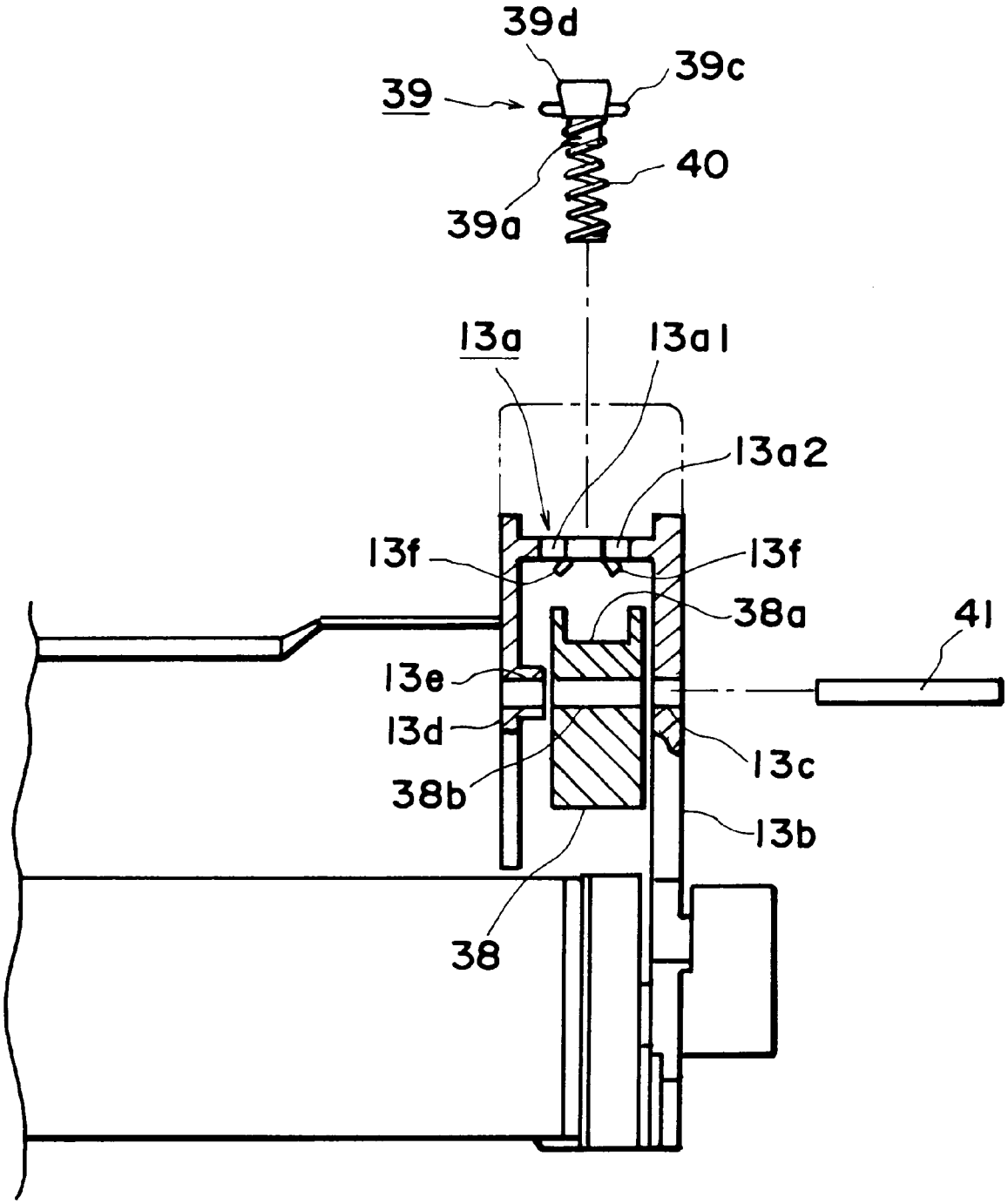
FIG. 2 is a sectional view depicting the internal structure of the joint between the development frame and the cleaning frame.
Figure 3:
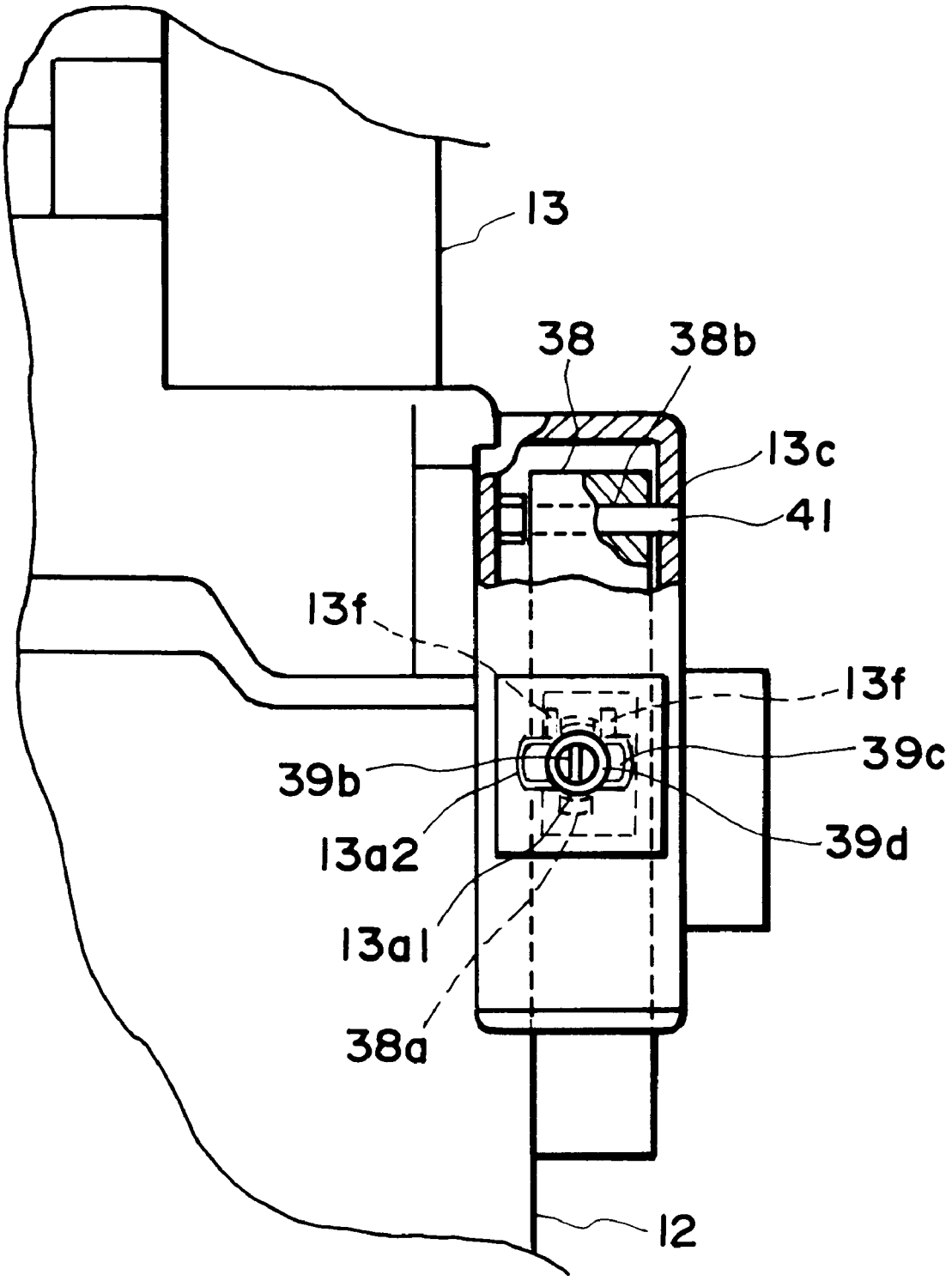
FIG. 3 is a partially cutaway plan view of the joint between the development frame and the cleaning frame.

Next, referring to FIGS. 1–3, the structure for joining the development frame 12 and the cleaning frame 13 will be described. FIG. 1 is a perspective view of both frames 12 and 13, depicting how they are joined. FIG. 2 depicts the internal structure of the joint, and FIG. 3 is a partially cutaway schematic plan view of the joint. The structures of the left and right joints at which the frames 12 and 13 are rotatively connected to each other with the arm portions 38 are the same; therefore, the structure on only one side will be described.

Referring to FIGS. 2 and 3, in order to give some elastic flexibility to the angle formed between the development frame 12 and the cleaning frame 13, the process cartridge B is provided with a compression spring 40, which is attached to a compression spring anchoring member 39 which integrally comprises a spring attachment portion 39*a* and a cylindrical portion 39*d*. The cylindrical portion 39*d* has a larger diameter than the diameter of the compression spring 40 attached to the spring attachment portion 39*a*. The head portion of the cylindrical portion is provided with a rib 39*b,* and the peripheral surface of the cylindrical portion 39*d* is provided with two flanges 39*c*.

The upward facing surface of the arm portion 38 of the development frame 12 is provided with a recess 38*a* (receiving portion). The location of the recess 38*a* is such that after the development frame 12 and the cleaning frame 13 are rotatively joined as will be described later, the recess 38*a* is located right below the attachment hole 13*a* of the cleaning frame 13. Further, a through hole 38*b* through which a pin 41 is put is provided at the tip portion of the arm portion 38. The pin 41 will be described later.

On the other hand, the cleaning frame 13 is provided with an attachment hole 13*a* into which the aforementioned spring anchoring member 39 is pressed. Referring to FIGS. 2 and 3, the attachment hole 13*a* is constituted of a cylindrical hole portion 13*a*1 slightly larger than the flange 39*c* or the cylindrical portion 39*d* of the spring anchoring member 39, and a cutaway portion 13*a*2. The external wall 13*b* of the cleaning frame 13 is provided with a hole 13*c* through which the pin 41 is put, and the internal wall 13*d* of the cleaning frame 13 is provided with a hole 13*e* into which the pin 41 is pressed. The axial lines of the holes 13*c* and 13*e* coincide with each other, and are parallel to the axial lines of the holes 13*c* and 13*e* provided on the other side, relative to the longitudinal direction, of the cleaning frame 13. Further, a rib 13*f* is provided on the interior surface of the cleaning frame 13, adjacent to the attachment hole 13*a*.

Referring to FIGS. 2 and 3, when the development frame 12 and cleaning frame 13 are joined using the above structure, first, the arm portion 38 of the development frame 12 is inserted into the joining portion 13*h* of the cleaning frame 13. Next, the pin 41 is put through the hole 13*c* of the cleaning frame 13, and the through hole 38*b* of the arm portion 38, in this order, and then is pressed into the hole 13*e*. As a result, the development frame 12 and cleaning frame 13 are joined in such a manner that they are rotatable about the pin 41. At this stage of the process cartridge B assembly, no pressure is present to press the photosensitive drum 7 and development roller 10*d* toward each other; therefore, assembly workers can easily examine the degree of the rotatability of both components.

Next, referring to FIG. 2, the spring anchoring member 39 to which the spring 40 has been attached is put through the attachment hole 13*a;* the cutaway portion 13*a*2 of the attachment hole 13*a,* and the flange 39*c* of the spring anchoring member 39, are aligned, with the tip of the spring 40 placed in contact with the bottom surface of the recess 38*a,* and the spring anchoring member 39 is pressed straight down in the compressing direction of the spring 40 until the upper surface of the flange 39*c* of the spring anchoring member 39 comes to be located below the rib 13*f,* and the cylindrical portion 39*d* comes to be guided by the cylindrical hole portion 13*a*1 of the attachment hole 13*a*. In this state, the spring anchoring member 39 is rotated 90°, and is released. Consequently, the spring anchoring member 39 is pushed up, being guided by the cylindrical hole portion 13*a*1, by the resiliency of the spring 40, and is stopped at a point at which the flange 39*c* strikes the bottom edge of the attachment hole 13*a*.

As a result, the development roller 10*d* mounted in the development frame 12 is pressed toward he photosensitive drum 7 mounted in the cleaning frame 13, coming in contact with the ring members (unillustrated) as spacers mounted at the longitudinal ends of the development roller 10*d,* and thereby coming to be accurately positioned relative to the photosensitive drum 7. At the same time, the drum gear fixed to the longitudinal end of the photosensitive drum 7 becomes engaged with a roller gear fixed to the longitudinal end of the development roller 10*d,* enabling the driving force to be transmitted.

{Process Cartridge}

The aforementioned process cartridge B has the following structure. The process cartridge B removably installable in the main assembly of an image forming apparatus A comprises a drum frame 13 (cleaning frame), a development frame 12, and a toner frame 12*a*. The drum frame 13 houses a electro-photographic photosensitive drum 7, a cr8 for charging the electro-photographic photosensitive drum 7, a cleaning blade 11*a* for removing the toner remaining on the electro-photographic photosensitive drum 7, wherein the cr8 is in contact with the electro-photographic photosensitive drum 7, and the cb11*a* is in contact with the electro-photographic photosensitive drum 7. The development frame 12 houses a development roller 10*d* for developing the latent image formed on the electro-photographic photosensitive drum 7, and the toner frame 12*a* comprises a toner holding portion 10 for holding the toner used for the aforementioned development. The tf12*a* is joined with the development frame 12 along their longitudinal edges, and also supports an arm portion 38. The arm portion 38 is disposed at each longitudinal end of the tf12*a,* and projects toward the drum frame 13 in the direction perpendicular to the longitudinal direction thereof, enabling the development frame 12 and the df13 to be joined so as to be oscillatable relative to each other. Also, the tf12*a* comprises handhold portions 12*a*10 and 12*c*2 for holding the process cartridge B. They are located on the opposite side of the tf12*a* relative to the dr13. The handhold portions 12*a*10 and 12*c*2 are partially constituted of the lid 12*c* of the toner holding portion 10*a* of the tf12*a;* therefore, they become the part of the tf12*a* as the lid 12*c* is attached to the tf12*a*. Further, the tf12*a* is provided with a toner filling opening 12*a*2 through which the toner is filled, and a toner supply opening 12*a*1 for supplying to the development roller 10*d* the toner held in the toner holding portion 10*a,* and a toner seal mount 12*a*5 on which a toner seal 31 is attached. the toner filling opening 12*a*2 is located at one of the longitudinal ends of the tf12*a,* and the toner supply opening 12*a*1 and the toner seal mount 12*a*5 extends in the longitudinal direction of the tf12*a*. The toner seal 31 unsealably seals the toner supply opening 12*a*1. The tf12*a* and the development frame 12 are joined by a pin 41 placed through a hole 38*b* of the arm portion 38, and holes 13*c* and 13*e* of the df13, wherein the development frame 12 joined with the tf12*a,* and the df13, are rotatable about the pin 41.

In other words, in this embodiment, after the first frame 12 and second frame 13 are rotatively joined, and the degree of the rotatability of the photosensitive drum 7 and development roller 10*d* is confirmed, the photosensitive drum 7 and the development roller 10*d* are pressed toward each other by the spring 40 anchored by the spring anchoring member 39; therefore, the possibility of the fluctuation of the pressure applied to the photosensitive drum 7 by the development roller 10*d* is eliminated. Further, the spring anchoring member 39 is attached so as to keep appropriately compressed the compression spring 40 attached to the spring anchoring member 39; therefore, the compression spring 40 is not liable to buckle. Further, the spring anchoring member 39 can be replaced without removing the spring cover. In other words, the spring anchoring member 39 can be replaced, the first and second frames 12 and 13 remaining connected, enabling the spring anchoring member 39 to be exchanged with a spring anchoring member with a spring having a proper pressure, substantially regardless of the cartridge assembling order.

Consequently, the assembly efficiency for the process cartridge B is improved. In addition, when an image is formed using the process cartridge B described above, the pressure applied by the development roller 10*d* does not fluctuate as described above; therefore, a high quality image can be produced.

{Other Embodiment}

Next, various components of the process cartridge B and the image forming apparatus in accordance with the present invention will be described.

In the preceding embodiment, one of the arm portions 38 for connecting the development frame 12 and the cleaning frame 13 was disposed on the gear cover 37, and this gear cover 37 was fixed to one of the longitudinal ends of the development frame 12, but both arm portions 38 may be directly formed on the toner holding frame portion 12*a*. This arrangement can also effectively disperse the shock generated during the installation of the process cartridge B.

Further, in the preceding embodiment, the link supporting member 30 was welded to the cartridge frame, but the link supporting member 30 may be screwed to the cartridge frame, or may be glued to the cartridge frame with adhesive.

{Internal Structure of Toner Holding Frame}

Figure 21:
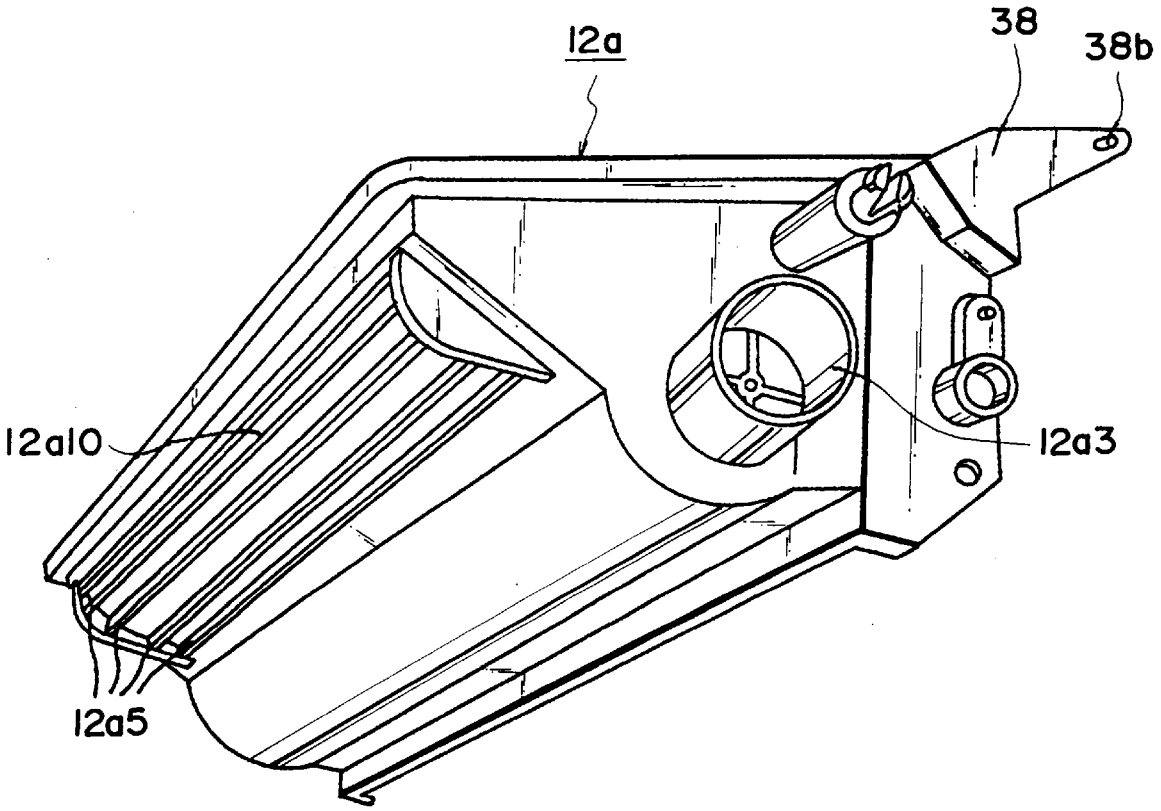
FIG. 21 is a perspective view of a toner accommodating container.
Figure 22:
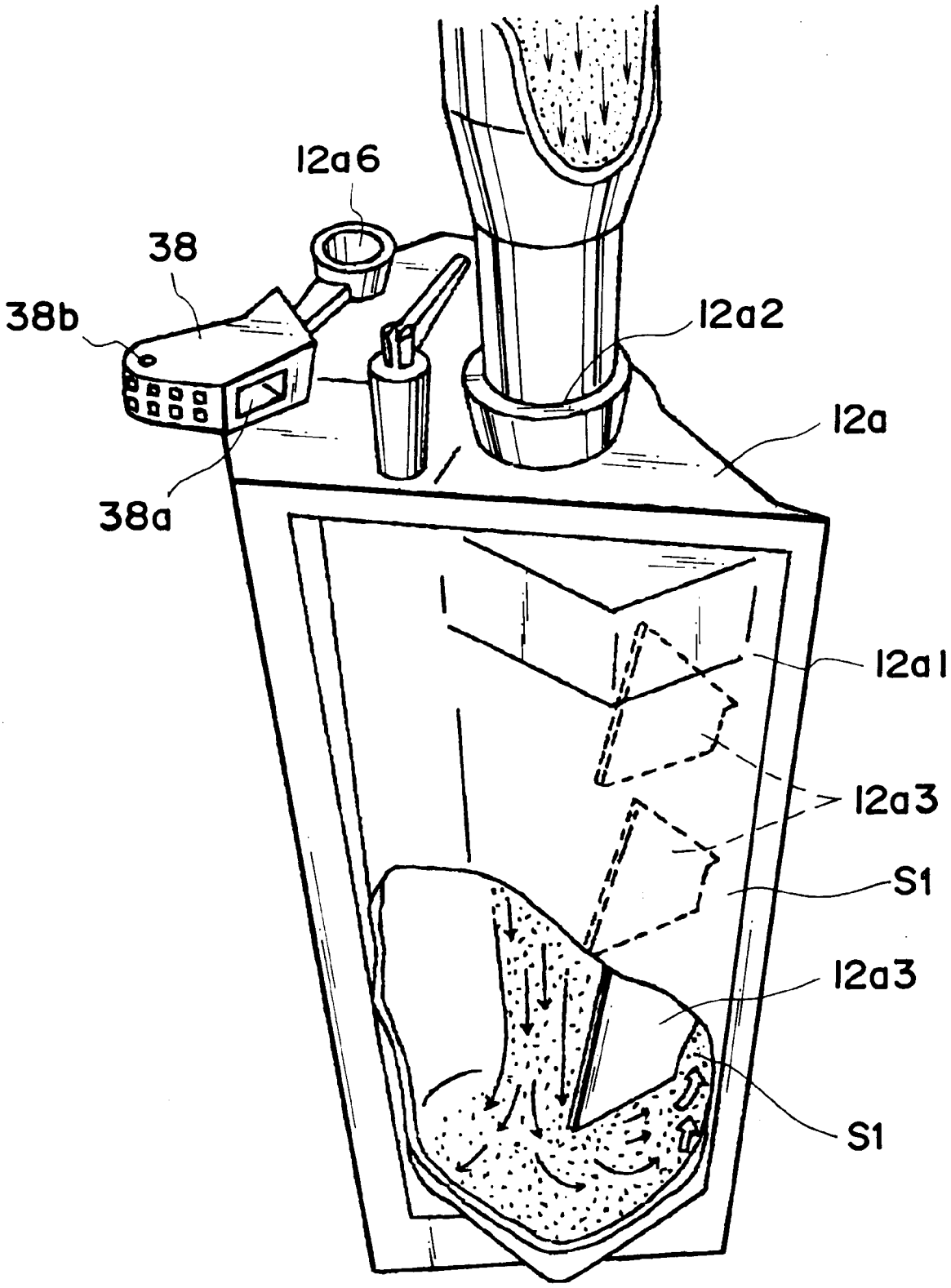
FIG. 22 is a perspective view thereof when the toner is filled.

Next, referring to FIGS. 21 and 22, the internal structure of the toner holding frame portion 12*a* will be described. As will be become clear from the following description, partition members 12a3 are provided within the toner holding frame portion 12a, wherein a gap is provided between the partition member 12a3 and the frame lid 12c. This arrangement is made so that even when the frame lid 12c is flexed as the users too firmly grasp the toner holding frame portion 12a (pcB), the flexed portion of the frame lid 12c can be supported by the top surface of the partition member 12a3.

A gap is also provided between the partition member 12a3 and the toner holding portion 10a. This arrangement is made so that the toner poured into the toner holding portion 10a through the toner filling opening 12a2 can be delivered with preferable efficiency into each of the spaces partitioned by the partition members 12a3 in spite of the presence of the partition members 12a3.

Figure 9:
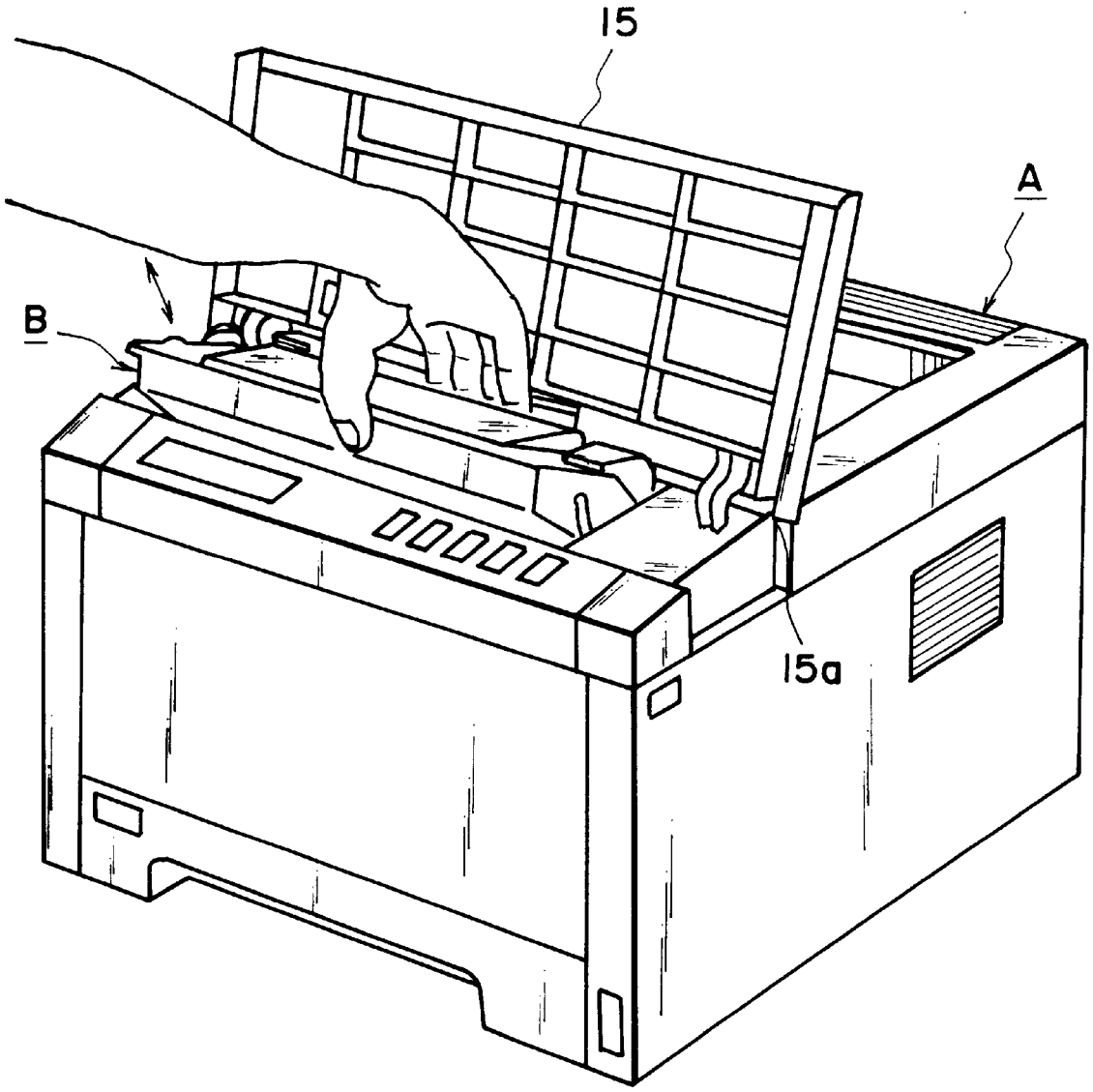
FIG. 9 is a perspective view depicting how the process cartridge is installed into the image forming apparatus.
Figure 10:
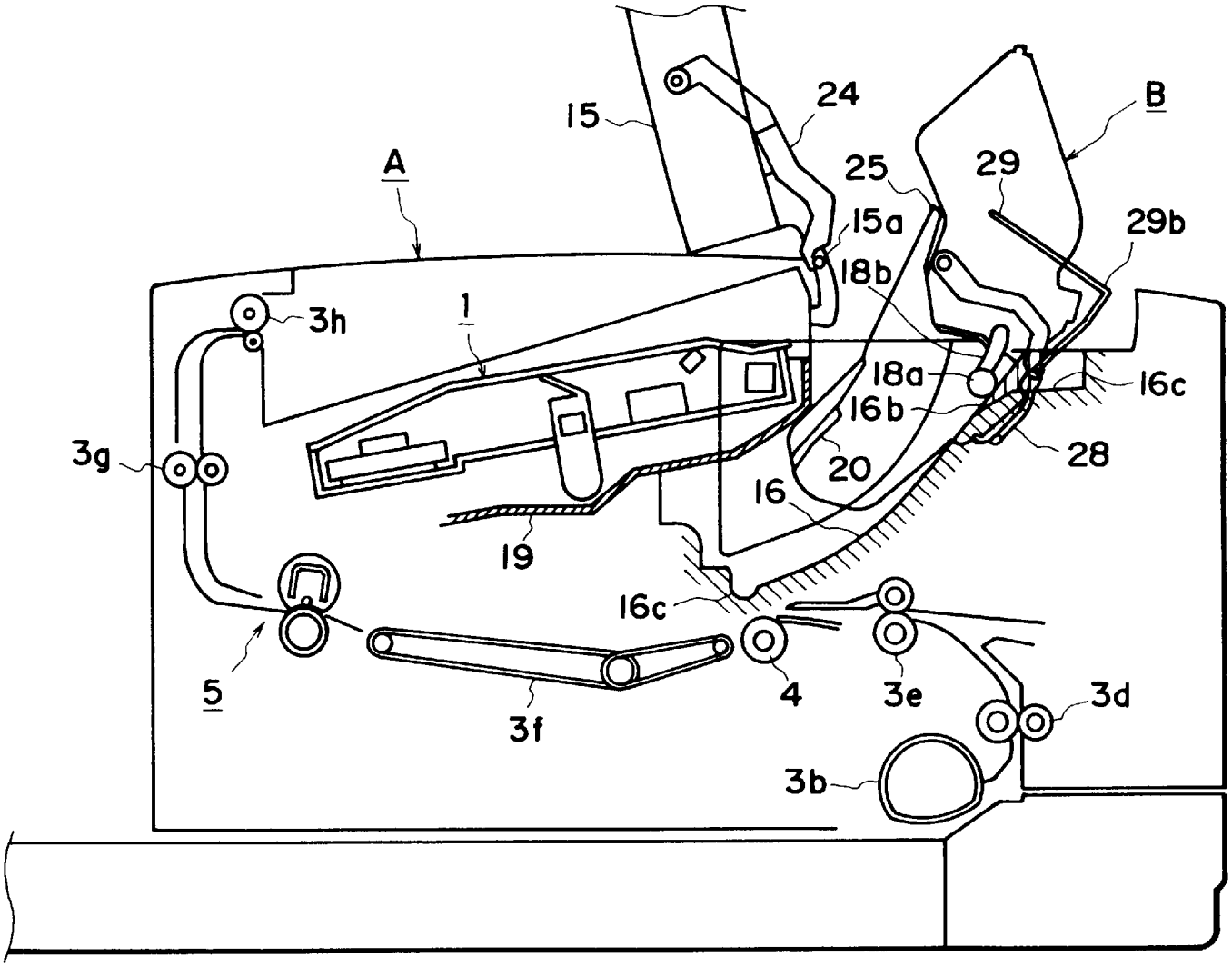
FIG. 10 is a sectional explanatory drawing depicting the state of the process cartridge having been partially inserted into the image forming apparatus.

Referring to FIG. 16, the slant surface on the top of the frame lid 12c is provided with several parallel ribs 12c1, constituting a handhold portion 12c2. Further, referring to FIG. 21, the bottom portion of the toner holding frame portion 12a is provided with an R portion which bulges downward. The external surface of the R portion is also provided with several parallel ribs 12a5, constituting a handhold portion 12a10. The users can easily hold the process cartridge B by grasping the handhold portions 12a10 and 12c2, so that the process cartridge B can be smoothly installed into, or removed from, the image forming apparatus A (FIG. 9).

At this time, the relationship between the partition member 12a3 provided within the toner holding portion 10a, and the frame wall surface will be described. Referring to FIG. 5, a gap S1 is provided between the rear edge of the partition member 12a3 and the internal surface of the rear wall of the toner holding frame portion 12a ("rear" relative to the direction in which the toner within the toner holding portion 10a is supplied to the development roller 10d). Also, a minute gap S2 is provided between the top end of the partition member 12a3 and the internal surface of the frame lid 12c.

The purpose of the partition member 12a3 is to minimize the deformation of the toner holding frame portion 12a and the frame lid 12c when excessive pressure is applied by the users who handle the process cartridge B by gripping the handhold portions 12c2 and 12a10. In other words, even if the users too firmly grasp the process cartridge B, and consequently, the toner holding frame portion 12a and/or the frame lid 12c become deformed, the top end of the partition member 12a3 and the internal surface of the frame lid 12c come in contact with each other, regulating the amount of the deformation.

With the presence of the partition members 12a3 within the toner holding portion 10a, unless the internal air of the toner holding portion 10a is properly released while the toner is filled, the toner cannot be filled with sufficiently high density.

Thus, in this embodiment, the gap S1 is provided between the partition member 12a3 and the internal surface of the rear wall of the toner holding frame portion 12a as described above. Consequently, when the toner is filled through the toner filling opening 12a2, the internal air of the toner holding portion 10a is allowed to flow through the gap S1 and out of the toner holding portion 10a as illustrated in FIG. 22 (a black arrow mark indicates the toner flow, and a white arrow mark indicates the air flow). As a result, the toner can be smoothly filled into the toner holding portion 10a, with a sufficient density.

It should be noted here that in order to provide a proper balance between the air releasing efficiency and the effectiveness in regulating the frame deformation, the gap S1 is preferred to be 5 mm–20 mm.

Also as described before, in this embodiment, the gap S2 is provided between the top end of the partition member 12a3 and the frame lid 12c; therefore, the generation of burr is prevented. More specifically, when the frame lid 12c is attached to the toner holding frame portion 12a without providing the gap S2, the top end of the partition member 12a3 and the internal surface of the frame lid 12c sometimes make contact due to manufacturing error. If the toner holding frame portion 12a and the frame lid 12c are welded together by ultrasonic welding when the partition member 12a3 and the frame lid 12c are in contact with each other, the burr may be generated between the top end of the partition member 12a3 and the internal wall of the frame lid 12c, and when generated, the burr is liable to drop into the toner holding portion 10a, and mix with the toner, forming a toner nucleus, during the transportation of the process cartridge B, or in the like situation. But, according to the present invention, the generation of the burr can be prevented.

On the other hand, when the gap S2 is too large, the internal pressure of the toner holding portion 10a is liable to increase. This is because when the handhold portion formed on the frame lid 12c welded to the toner holding frame portion 12a using ultrasonic welding is firmly gripped, the presence of an excessive gap is liable to allow both frame portions to deform. Thus, the size of the gap S2 is preferred to be set within a range of 0.0–0.5 mm so that when the handhold portions are firmly gripped, the deformation of the toner holding frame portion 12a and the frame lid 12c can be minimized. In this embodiment, the gap S2 is set at 0.2 mm.

As is evident from the above descriptions, not only does the provision of the gaps S1 and S2 between the partition member 12a3 and the internal surface of the frame allow the toner to be filled with high density, but also, prevents the burr from mixing into the toner, and minimizes the frame deformation.

A process cartridge B is detachably mountable to a main assembly of an image forming apparatus, and comprises: a. an electrophotographic photosensitive drum 7; b. a developing roller 10d for developing a latent image formed on the electrophotographic photosensitive drum 7, the developing roller supplying toner to the electrophotographic photosensitive drum 7 by rotation thereof; c. a charging roller 8 for charging the electrophotographic photosensitive drum 7, the charging roller 8 being contacted to the electrophotographic photosensitive drum 7; d. a cleaning blade 11a for removing residual toner from the electrophotographic photosensitive drum 7; e. a toner accommodating container 12a, including: a toner accommodating portion 10a for accommodating toner usable for developing a latent image formed on the electrophotographic photosensitive drum 7, wherein the toner accommodating portion 10a is provided with a toner supply opening 12a1 for supplying the toner to the electrophotographic photosensitive drum 7 from the toner accommodating portion 10a; a partition wall 12a3 extending in the toner accommodating portion in a direction along a short side of the toner accommodating portion to define a plurality of space therein, wherein the toner accommodating portion has a bottom surface slanted down toward the toner supply opening, and the partition is provided on the slanted surface; a toner filling opening 12a2, at a longitudinal end of the toner accommodating portion, for permitting toner to b filled into the toner accommodating portion; and a through-passage S1 extending from one longitudinal end to the other longitudinal end along a length of the toner accommodating portion so as to permit the toner to be supplied into the spaces, the through-passage being formed between a wall surface of the toner accommodating portion and the partition wall, wherein the through-passage S1 is provided between a rear wall surface opposed to the toner supply opening and the partition wall.

Also, a process cartridge B is detachably mountable to a main assembly of an image forming apparatus, and comprises: a. an electrophotographic photosensitive drum 7; b. a developing roller 10*d* for developing a latent image formed on the electrophotographic photosensitive drum 7, the developing roller supplying toner to the electrophotographic photosensitive drum 7 by rotation thereof; c. a charging roller 8 for charging the electrophotographic photosensitive drum 7, the charging roller 8 being contacted to the electrophotographic photosensitive drum 7; d. a cleaning blade 11*a* for removing residual toner from the electrophotographic photosensitive drum 7; e. a toner accommodating container 12*a,* including: a toner accommodating portion 10*a* for accommodating toner usable for developing a latent image formed on the electrophotographic photosensitive drum 7, wherein the toner accommodating portion 10*a* is provided with a toner supply opening 12*a*1 for supplying the toner to the electrophotographic photosensitive drum 7 from the toner accommodating portion 10*a;* a cover member 12*c* for covering an opening other than the toner supply opening 12*a*1, wherein the cover member 12*c* covers the opening provided at an upper portion of the toner accommodating portion 10*a,* which portion takes an upper position when the process cartridge is mounted on the main assembly of the image forming apparatus; a handle portion 12*c*2 on the cover member 12*c* for facilitating handling of the toner accommodating container, wherein the handle 12*c*2 has a plurality of ribs 12*c*1. The outer surface of the toner accommodating container has a plurality of ribs 12*a*9. When the container 12*a* is handled, the rib of the cover and the rib of the container 10*a*.

In order to fill the toner into the portion 10*a,* there are provided a toner filling opening 12*a*2 at one longitudinal end of the accommodating portion, the partition wall 12*a*3 for partitioning the inside space of the portion 10*a*. A gap S2 is formed between the cover member 12*c* and the partition wall 12*a*3. When the cover bends upon gripping the toner accommodating container, the partition wall 12*a*3 and the cover 12*c* are contactable. The gap S2 between the partition wall 12*a*3 and the cover 12*c* is not more than approx. 0.5 mm. The toner accommodating portion 10*a* and the cover 12*c* are welded.

Further, the aforementioned process cartridge B was of a type for forming a monochromatic image. However, not only is the present invention preferably applicable to the process cartridge which forms a monochromatic image, but also to a cartridge which comprises two or more developing means, and forms a multi-color image (for example, a two-color image, a three-color image, a full-color image, and the like).

As for the developing method, various known development methods such as the magnetic brush development method employing two component toner, the cascade development method, the touch down development method, or cloud development method may be employed.

The electro-photographic photosensitive member is not limited to the photosensitive drum. For example, the following may be included.

First, as the photosensitive material, photoconductive material such as amorphous silicon, amorphous selenium, zinc oxide, titanium oxide, or organic photoconductor (OPC) may be included. As for the shape of the base member on which the photosensitive material is placed, a rotary member such as a drum or a member in the form of a sheet such as an endless belt, are included. Generally, a member in the form of a drum or a belt is employed. For example, a photosensitive drum comprises a cylinder of aluminum alloy or the like, and photoconductive material deposited or coated thereon.

The structure of the charging means described in the preceding embodiment was of the so-called contact type, but it is obvious that other conventional structures may be employed, for example, a structure in which a tungsten wire is surrounded on three sides by a shield of metallic material such as aluminum, and positive or negative ions generated by applying a high voltage to the tungsten wire are transferred onto the surface of the photosensitive drum to uniformly charge the drum surface.

As for the charging means, a charging means of the blade type (charging blade), the pad type, the block type, the rod type, the wire type, or the like may be employed in addition to the roller type charging means described in the preceding embodiment.

Regarding the method for cleaning the toner remaining on the photosensitive drum, the cleaning means may comprise a blade, a fur brush, a magnetic brush, or the like.

The process cartridge in accordance with the present invention comprises at least an electro-photographic photosensitive member and a developing means. Typically, a combination of a developing means, an electro-photographic photosensitive member, a charging means, and a cleaning means, a combination of a developing means, an electro-photographic photosensitive member, and a charging means or a cleaning means, a combination of a developing means and an electro-photographic photosensitive member, or the like combination is integrated in the form of a cartridge so that it can be removably installed into the main assembly of an apparatus.

Further, in the preceding embodiment, the image forming apparatus was represented by a laser beam printer, but the present invention is not limited by the preceding embodiment. Obviously, the present invention is also applicable to other image forming apparatuses such as an electro-photographic copying machine, a facsimile apparatus, or a word processor.

As described in the foregoing, according to the present invention, the gap or clearance is provided between the partition member and the inside surface of the frame, so that when the toner is filled thereinto, the air can be removed smoothly from the inside. Therefore, the toner can be filled at high density, thus permitting to fill a large amount of toner. The running cost can be minimized with downsizing.

While the invention has been described with reference to the structures disclosed herein, it is not confined to the details set forth, and this application is intended to cover such modifications or changes as may come within the purposes of the improvements or the scope of the following claims.

What is claimed is:

1. A toner accommodating container usable with an image forming apparatus, comprising:

a toner accommodating portion for accommodating toner usable for developing a latent image formed on said electrophotographic photosensitive member;

a partition wall extending in said toner accommodating portion in a direction along a short side of said toner accommodating portion to define a plurality of spaces therein;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner having entered through said toner filling opening to be supplied into the spaces; and a second through-passage for permitting air to pass when the toner enters through said toner filling opening wherein said second through-passage is provided between an internal wall surface and said partition wall.

2. A container according to claim 1, wherein said toner accommodating portion is provided with a toner supply opening for supplying the toner, and said toner accommodating portion has a bottom surface slanted down toward said toner supply opening, and said partition is provided on the slanted surface.

3. A container according to claim 2, wherein said toner supply opening is unsealably sealed by a seal.

4. A process cartridge according to claim 3, wherein said toner supply opening is unsealably sealed by a seal.

5. A container according to claim 2, wherein said first through-passage is disposed between said toner supply opening and said partition wall.

6. A container according to claim 5, wherein said first through-passage is disposed between said toner supply opening and said partition wall.

7. A container according to claim 1, wherein said toner accommodating portion is provided with a cap member, which is in turn provided with a handle, and a portion of said cap member which is bent when said handle is gripped, is supported by said partition, and said cap member covers a top part of said toner accommodating portion.

8. A container according to claim 1, wherein a process cartridge with which said toner accommodating container is usable, contains said electrophotographic photosensitive member in the form of a drum, a charging roller, a developing roller and a cleaning blade, wherein said charging roller functions to charge said electrophotographic photosensitive member and contacts said electrophotographic photosensitive member, and said developing roller is rotatable to supply the toner to said electrophotographic photosensitive member, and said cleaning blade contacts said electrophotographic photosensitive member to remove remaining toner from said electrophotographic photosensitive member.

9. A container according to claim 1, wherein said toner accommodating portion is provided with a toner supply opening for supplying the toner, and said second through-passage is provided between a rear wall surface as said internal wall surface, opposed to said toner supply opening and said partition wall.

10. A container according to claim 1 or 9, wherein the toner having entered through said toner filling opening can enter said second through-passage after it passes through said first through-passage.

11. A container according to claim 10, wherein said second through-passage comprises a gap of 5–20 mm.

12. A container according to claim 11, wherein said second through-passage comprises a gap of 5–20 mm.

13. A toner accommodating container usable with a process cartridge detachably mountable to a main assembly of an image forming apparatus, wherein said process cartridge includes an electrophotographic photosensitive drum and a developing roller for developing a latent image formed on said electrophotographic photosensitive drum, comprising:

a toner accommodating portion for accommodating toner usable for developing a latent image formed on said electrophotographic photosensitive drum, wherein said toner accommodating portion is provided with a toner supply opening for supplying the toner to said electrophotographic photosensitive drum from said toner accommodating portion;

a partition wall extending in said toner accommodating portion in a direction along a short side of said toner accommodating portion to define a plurality of spaces therein;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner having entered through said toner filling opening to be supplied into the spaces; and a second through-passage for permitting air to pass when the toner enters through said toner filling opening wherein said second through-passage is provided between a rear wall surface opposed to said toner supply opening and said partition wall.

14. A container according to claim 13, wherein said toner accommodating portion has a bottom surface slanted down toward said toner supply opening, and said partition is provided on the slanted surface.

15. A container according to claim 13, wherein said toner accommodating portion is provided with a cap member, which is in turn provided with a handle, and a portion of said cap member, which is bent when said handle is gripped, is supported by said partition, and wherein said cap member covers a top part of said toner accommodating portion.

16. A container according to claim 13, wherein said process cartridge further comprises a charging roller and a cleaning blade, wherein said charging roller functions to charge said electrophotographic photosensitive drum and contacts said electrophotographic photosensitive drum, and said cleaning blade contacts said electrophotographic photosensitive drum to remove remaining toner from said electrophotographic photosensitive drum.

17. A container according to claim 13, wherein the toner having entered through said toner filling opening can enter said second through-passage after it passes through said first through-passage.

18. A container according to claim 13 or 17, wherein said second through-passage comprises a gap of 50–20 mm.

19. A container according to claim 13, wherein said toner supply opening is unsealably sealed by a seal.

20. A toner accommodating container usable with a process cartridge detachably mountable to a main assembly of an image forming apparatus, wherein said process cartridge includes an electrophotographic photosensitive drum and a developing roller for developing a latent image formed on said electrophotographic photosensitive drum, a charging roller for charging said electrophotographic photosensitive drum, and a cleaning blade for removing residual toner from said electrophotographic photosensitive drum, comprising:

a toner accommodating portion for accommodating toner usable for developing a latent image formed on said electrophotographic photosensitive drum, wherein said toner accommodating portion is provided with a toner supply opening, unsealably sealed by a seal, for supplying the toner to said electrophotographic photosensitive drum from said toner accommodating portion;

a partition wall extending in said toner accommodating portion in a direction along a short side of said toner accommodating portion to define a plurality of spaces therein, wherein said toner accommodating portion has a bottom surface slanted down toward said toner supply opening, and said partition is provided on the slanted surface;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner having entered through said toner filling opening to be supplied into the spaces; and a second through-passage for permitting air to pass when the toner enters through said toner filling opening, wherein said second through-passage is provided between a rear wall surface opposed to said toner supply opening and said partition wall, and wherein the toner having entered through said toner filling opening can enter said second through-passage after it passes through said first through-passage, and wherein said first through-passage is disposed between said toner supply opening and said partition wall.

21. A container according to claim 20, wherein said toner accommodating portion is provided with a cap member, which is in turn provided with a handle, and a portion of said cap member which is bent when said handle is gripped, is supported by said partition, and said cap member covers a top part of said toner accommodating portion.

22. A process cartridge detachably mountable to a main assembly of an image forming apparatus, comprising:

a. an electrophotographic photosensitive member;

b. process means actable on said electrophotographic photosensitive member;

c. a toner accommodating container, including:

a toner accommodating portion for accommodating toner usable for developing a latent image formed on said electrophotographic photosensitive member;

a partition wall extending in said toner accommodating portion in a direction along a short side of said toner accommodating portion to define a plurality of spaces therein;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner having entered through said toner filling opening to be supplied into the spaces; and a second through-passage for permitting air to pass when the toner enters through said toner filling opening, wherein said second through-passage is provided between an internal rear wall surface opposed to said toner supply opening and said partition wall.

23. A process cartridge according to claim 22, wherein said toner accommodating portion is provided with a toner supply opening for supplying the toner, and said toner accommodating portion has a bottom surface slanted down toward said toner supply opening, and said partition is provided on the slanted surface.

24. A process cartridge according to claim 23, wherein said toner supply opening is unsealably sealed by a seal.

25. A process cartridge according to claim 23, wherein said first through-passage is disposed between said toner supply opening and said partition wall.

26. A process cartridge according to claim 22, wherein said toner accommodating portion is provided with a cap member, which is in turn provided with a handle, and a portion of said cap member which is bent when said handle is gripped, is supported by said partition, and said cap member covers a top part of said toner accommodating portion.

27. A process cartridge according to claim 22, wherein said process cartridge contains said electrophotographic photosensitive member, and at least one of a charging roller, a developing roller and a cleaning blade as said process means, wherein said process cartridge is detachably mountable relative to a main assembly of the image forming apparatus as an unit.

28. A process cartridge according to claim 22, wherein said toner accommodating portion is provided with a toner supply opening for supplying the toner, and said second through-passage is provided between a rear wall surface as said internal wall surface, opposed to said toner supply opening and said partition wall.

29. A process cartridge according to claim 22 or 28, wherein the toner having entered through said toner filling opening can enter said second through-passage after it passes through said first through-passage.

30. A process cartridge according to claim 29, wherein said second through-passage comprises a gap of 5–20 mm.

31. A process cartridge detachably mountable to a main assembly of an image forming apparatus, comprising:

a. an electrophotographic photosensitive drum;

b. process means actable on said electrophotographic photosensitive drum;

c. a toner accommodating container including:

a toner accommodating portion for accommodating toner usable for developing a latent image formed on said electrophotographic photosensitive drum, wherein said toner accommodating portion is provided with a toner supply opening for supplying the toner to said electrophotographic photosensitive drum from said toner accommodating portion;

a partition wall extending in said toner accommodating portion in a direction along a short side of said toner accommodating portion to define a plurality of spaces therein;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner to be supplied into the spaces, and a second through-passage for permitting air to pass when the toner enters through said toner filling opening, wherein said second through-passage is provided between a rear wall surface opposed to said toner supply opening and said partition wall.

32. A process cartridge according to claim 31, wherein said toner accommodating portion has a bottom surface slanted down toward said toner supply opening, and said partition is provided on the slanted surface.

33. A process cartridge according to claim 31, wherein said toner accommodating portion is provided with a cap member, which is in turn provided with a handle, and a portion of said cap member which is bent when said handle is gripped, is supported by said partition, and said cap member covers a top part of said toner accommodating portion.

34. A process cartridge according to claim 31, wherein said process cartridge further comprises a charging roller and a cleaning blade, wherein said charging roller functions to charge said electrophotographic photosensitive drum and contacts said electrophotographic photosensitive drum, and said cleaning blade contacts said electrophotographic photosensitive drum to remove remaining toner from said electrophotographic photosensitive drum.

35. A process cartridge according to claim 31, wherein the toner having entered through said toner filling opening can enter said second through-passage after it passes through said first through-passage.

36. A process cartridge according to claim 31 or 35, wherein said second through-passage comprises a gap of 5–20 mm.

37. A process cartridge according to claim 31, wherein said first through-passage is disposed between said toner supply opening and said partition wall.

38. A process cartridge detachably mountable to a main assembly of an image forming apparatus, comprising:

a. an electrophotographic photosensitive drum;

b. a developing roller for developing a latent image formed on said electrophotographic photosensitive drum, said developing roller supplying toner to said electrophotographic photosensitive drum by rotation thereof;

c. a charging roller for charging said electrophotographic photosensitive drum, said charging roller contacting said electrophotographic photosensitive drum;

d. a cleaning blade for removal residual toner from said electrophotographic photosensitive drum; and e. a toner accommodating container, including:

a toner accommodating portion for accommodating toner usable for developing a latent image formed on said electrophotographic photosensitive drum, wherein said toner accommodating portion is provided with a toner supply opening, unsealably sealed by a seal, for supplying the toner to said electrophotographic photosensitive drum from said toner accommodating portion;

a partition wall extending in said toner accommodating portion in a direction along a short side of said toner accommodating portion to define a plurality of spaces therein, wherein said toner accommodating portion has a bottom surface slanted down toward said toner supply opening, and said partition is provided on the slanted surface;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner having entered through said toner filling opening to be supplied into the spaces; and a second through-passage for permitting air to pass when the toner enters through said toner filling opening, wherein said second-through passage is provided between a rear wall surface opposed to said toner supply opening and said partition wall, and wherein the toner having entered through said toner filling opening can enter said second through-passage after it passes through said first through-passage, and wherein said first through-passage is disposed between said toner supply opening and said partition wall.

39. A process cartridge according to claim 38, wherein said toner accommodating portion is provided with a cap member, which is in turn provided with a handle, and a portion of said cap member which is bent when said handle is gripped, is supported by said partition, and said cap member covers a top part of said toner accommodating portion.

40. A process cartridge according to claim 38, wherein said second through-passage comprises a gap of 5–20 mm.

41. An electrophotographic image forming apparatus for forming an image on a recording material, wherein a process cartridge is detachably mountable to said image forming apparatus, comprising:

a. mounting means for detachably mounting a process cartridge;

said process cartridge including:

aa. an electrophotographic photosensitive member;

bb. process means actable on said electrophotographic photosensitive member;

cc. a toner accommodating container, including:

a toner accommodating portion for accommodating toner usable for developing a latent image formed on said electrophotographic photosensitive member;

a partition wall extending in said toner accommodating portion in a direction along a short side of said toner accommodating portion to define a plurality of spaces therein;

a toner filling opening, at a longitudinal end of said toner accommodation portion, for permitting toner to be filled into said toner accommodating portion; and a first through-passage extending from one longitudinal end to the other longitudinal end along a length of said toner accommodating portion so as to permit the toner having entered through said toner filling opening to be supplied into the spaces; and a second through-passage for permitting air to pass when the toner enters through said toner filling opening, wherein said second through-passage is provided between an internal rear wall surface opposed to said toner supply opening and said partition wall;

said apparatus further comprising:

b. feeding means for feeding the recording material.

42. An electrophotographic image forming apparatus for forming an image on a recording material, wherein a process cartridge is detachably mountable to said image forming apparatus, comprising:

a. mounting means for detachably mounting a process cartridge;

said process cartridge including:

aa. an electrophotographic photosensitive drum;

bb. process means actable on said electrophotographic photosensitive drum;

cc. a toner accommodating container, including:

a toner accommodating portion for accommodating toner usable for developing a latent image formed on said electrophotographic photosensitive drum, wherein said toner accommodating portion is provided with a toner supply opening for supplying the toner to said electrophotographic photosensitive drum from said toner accommodating portion;

a partition wall extending in said toner accommodating portion in a direction along a short side of said toner accommodating portion to define a plurality of spaces therein;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner to be supplied into the spaces; and a second through-passage for permitting air to pass when the toner enters through said toner filling opening, wherein said second through-passage is provided between a rear wall surface opposed to said toner supply opening and said partition wall;

said apparatus further comprising:

b. feeding means for feeding the recording material.

43. An electrophotographic image forming apparatus for forming an image on a recording material, wherein a process cartridge is detachably mountable to said image forming apparatus, comprising:

a. mounting means for detachably mounting a process cartridge;

said process cartridge including:

aa. an electrophotographic photosensitive drum;

bb. a developing roller for developing a latent image formed on said electrophotographic photosensitive drum, said developing roller supplying toner to said electrophotographic photosensitive drum by rotation thereof;

cc. a charging roller for charging said electrophotographic photosensitive drum, said charging roller contacting said electrophotographic photosensitive drum;

dd. a cleaning blade for removing residual toner from said electrophotographic photosensitive drum;

ee. a toner accommodating container including:

a toner accommodating portion for accommodating toner usable for developing a latent image formed on said electrophotographic photosensitive drum, wherein said toner accommodating portion is provided with a toner supply opening, unsealably sealed with a seal, for supplying the toner to said electrophotographic photosensitive drum from said toner accommodating portion;

a partition wall extending in said toner accommodating portion in a direction along a short side of said toner accommodating portion to define a plurality of spaces therein, wherein said toner accommodating portion has a bottom surface slanted down toward said toner supply opening, and said partition is provided on the slanted surface;

a toner filling opening, at a longitudinal end of said toner accommodating portion, for permitting toner to be filled into said toner accommodating portion;

a first through-passage extending from one longitudinal end to the other longitudinal end along a length of said toner accommodating portion so as to permit the toner to be supplied into the spaces; and a second through-passage for permitting air to pass when the toner enters through said toner filling opening wherein said second through-passage is provided between a rear wall surface opposed to said toner supply opening and said partition wall, and wherein the toner having entered through said toner filling opening can enter said second through passage after it passes through said first through-passage, and wherein said first through-passage is disposed between said toner supply opening and said partition wall;

said apparatus further comprising:

b. feeding means for feeding the recording material.

* * * * *

UNITED STATES PATENT AND TRADEMARK OFFICE

CERTIFICATE OF CORRECTION

PATENT NO. : 5,899,602

DATED : May 4, 1999

INVENTOR(S) : SHINYA NODA, ET AL.

It is certified that error appears in the above-identified patent and that said Letters Patent is hereby corrected as shown below:

On the cover page

Below "[75] Inventors" insert --[73] ASSIGNEE: Canon Kabushiki Kaisha, Tokyo, Japan--.

Below "Primary Examiner - Sandra Brase" insert --Attorney, Agent, or Firm - Fitzpatrick, Cella, Harper & Scinto--.

Column 4

Line 48, "remaining" should read --remaining on--.

Column 5

Line 25, "Installating" should read --Installation--.
Line 28, "installating" should read --installation--.
Line 59, "above" should read --above- --.

Column 7

Line 16, "trated" should read --trate--.

Column 11

Line 34, "he" should read --the--.

UNITED STATES PATENT AND TRADEMARK OFFICE

CERTIFICATE OF CORRECTION

PATENT NO. : 5,899,602

DATED : May 4, 1999

INVENTOR(S) : SHINYA NODA, ET AL.

It is certified that error appears in the above-identified patent and that said Letters Patent is hereby corrected as shown below:

Column 16

Line 59, "said" should read --an--.

Column 17

Line 7, "opening" should read --opening,--.

Column 18

Line 18, "opening" should read --opening,--.
Line 45, "50-20 mm." should read --5-20 mm.--.

Column 20

Line 14, "an" should read --a--.

Column 21

Line 30, "removal" should read --removal of--.

Column 22

Line 14, "a" (second occurrence) should read --said--.
Line 51, "a" (second occurrence) should read --said--.

UNITED STATES PATENT AND TRADEMARK OFFICE

CERTIFICATE OF CORRECTION

PATENT NO. : 5,899,602

DATED : May 4, 1999

INVENTOR(S) : SHINYA NODA, ET AL.

It is certified that error appears in the above-identified patent and that said Letters Patent is hereby corrected as shown below:

Column 23

Line 24, "a" (second occurrence) should read --said--.

Column 24

Line 27, "opening" should read --opening,--.
Line 32, "through" should read --through- --.

Signed and Sealed this

Twenty-seventh Day of June, 2000

*Attest:*

*Attesting Officer*

Q. TODD DICKINSON

*Director of Patents and Trademarks*